US010669109B2

(12) United States Patent
Toyooka et al.

(10) Patent No.: US 10,669,109 B2
(45) Date of Patent: Jun. 2, 2020

(54) SHEET END POSITION REGULATING DEVICE, SHEET LOADER INCORPORATING THE SHEET END POSITION REGULATING DEVICE, SHEET FEEDING DEVICE INCORPORATING THE SHEET END POSITION REGULATING DEVICE, AND IMAGE FORMING APPARATUS INCORPORATING THE SHEET END POSITION REGULATING DEVICE

(71) Applicants: Tsugunao Toyooka, Tokyo (JP); Masayuki Ueda, Tokyo (JP); Hideki Tobinaga, Kanagawa (JP); Hajime Nishida, Kanagawa (JP)

(72) Inventors: Tsugunao Toyooka, Tokyo (JP); Masayuki Ueda, Tokyo (JP); Hideki Tobinaga, Kanagawa (JP); Hajime Nishida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/162,843

(22) Filed: Oct. 17, 2018

(65) Prior Publication Data

US 2019/0193968 A1 Jun. 27, 2019

(30) Foreign Application Priority Data

Dec. 25, 2017 (JP) ..... 2017-248312

(51) Int. Cl.
*B65H 1/04* (2006.01)
*B65H 5/02* (2006.01)
(Continued)

(52) U.S. Cl.
CPC ..... *B65H 5/025* (2013.01); *B65H 1/04* (2013.01); *B65H 1/266* (2013.01); *B65H 3/44* (2013.01);
(Continued)

(58) Field of Classification Search
CPC ..... B65H 1/00; B65H 2405/00; B65H 2405/1116; B65H 2405/112;
(Continued)

(56) References Cited

U.S. PATENT DOCUMENTS 6,916,019 B2 * 7/2005 Takahashi ..... B65H 1/04 271/145
8,770,578 B2 * 7/2014 Yamamoto ..... B65H 1/266 271/171
(Continued)

FOREIGN PATENT DOCUMENTS

JP 2000-007162 1/2000
JP 2004-142892 5/2004
JP 2015-229536 12/2015

*Primary Examiner* — Thomas A Morrison
(74) *Attorney, Agent, or Firm* — Harness, Dickey & Pierce, P.L.C.

(57) ABSTRACT

A sheet end position regulating device, which is included in an image forming apparatus, includes a first contact body disposed movable on a sheet loading portion on which a sheet is loaded and configured to contact an end portion of the sheet, a fixing body disposed movable between a fixing position at which a position of the first contact body to the sheet loading portion is fixed and a releasing position at which the position of the first contact body is released, and a second contact body disposed movable between a contact position at which the fixing body contacts a contact target portion to regulate movement of the fixing body form the fixing position to the releasing position and a non-contact position at which the fixing body does not contact the contact target portion.

20 Claims, 20 Drawing Sheets

(51) Int. Cl.
*B65H 3/44* (2006.01)
*B65H 5/06* (2006.01)
*B65H 1/26* (2006.01)

(52) U.S. Cl.
CPC ..... *B65H 5/062* (2013.01); *B65H 2402/5151* (2013.01); *B65H 2403/513* (2013.01); *B65H 2511/11* (2013.01); *B65H 2511/20* (2013.01)

(58) Field of Classification Search
CPC ..... B65H 2405/113; B65H 2405/114; B65H 2511/10; B65H 2511/12; B65H 2701/1131
USPC ..... 271/171
See application file for complete search history.

(56) References Cited

U.S. PATENT DOCUMENTS

| | | | |
|---|---|---|---|
| 2004/0135306 | A1 | 7/2004 | Takahashi |
| 2008/0203649 | A1 | 8/2008 | Watase et al. |
| 2012/0187623 | A1 | 7/2012 | Watase et al. |
| 2015/0132039 | A1 | 5/2015 | Tobinaga et al. |
| 2015/0251864 | A1 | 9/2015 | Aoyama et al. |
| 2016/0334748 | A1 | 11/2016 | Aoyama et al. |
| 2017/0115618 | A1 | 4/2017 | Tobinaga et al. |

* cited by examiner

SHEET END POSITION REGULATING DEVICE, SHEET LOADER INCORPORATING THE SHEET END POSITION REGULATING DEVICE, SHEET FEEDING DEVICE INCORPORATING THE SHEET END POSITION REGULATING DEVICE, AND IMAGE FORMING APPARATUS INCORPORATING THE SHEET END POSITION REGULATING DEVICE

CROSS-REFERENCE TO RELATED APPLICATION

This patent application is based on and claims priority pursuant to 35 U.S.C. § 119(a) to Japanese Patent Application No. 2017-248312, filed on Dec. 25, 2017, in the Japan Patent Office, the entire disclosure of which is hereby incorporated by reference herein.

BACKGROUND

Technical Field

This disclosure relates to a sheet end position regulating device, a sheet loader incorporating the sheet end position regulating device, a sheet feeder incorporating the sheet end position regulating device, and an image forming apparatus incorporating the sheet end position regulating device.

Related Art

Known sheet end position regulating devices, which regulate the position of the end portion of a sheet loaded on a sheet loader, includes a contact member that is disposed movable to the sheet loader on which the sheet is loaded to contact the end portion of the sheet and a fixing member that fixes the contact member to the sheet loader.

As an example of this type of sheet loaders, a known sheet loader includes a biasing member such as a coil spring to apply a biasing force so that the fixing member is located at a fixing position to fix the position of the contact member to the sheet loader. With this configuration, when an operating force is applied to an operation unit that operates along with the fixing member, the fixing member moves from a fixing position to a releasing position against the biasing force applied by the biasing member, and therefore the contact member becomes movable to the sheet loader.

SUMMARY

At least one aspect of this disclosure provides a sheet end position regulating device including a first contact body disposed movable on a sheet loading portion on which a sheet is loaded and configured to contact an end portion of the sheet, a fixing body disposed movable between a fixing position at which a position of the first contact body to the sheet loading portion is fixed and a releasing position at which the position of the first contact body is released, and a second contact body disposed movable between a contact position at which the fixing body contacts a contact target portion to regulate movement of the fixing body form the fixing position to the releasing position and a non-contact position at which the fixing body does not contact the contact target portion.

Further, at least one aspect of this disclosure provides a sheet loader including a sheet loading portion on which a sheet is loaded, and the above-described sheet end position regulating device disposed movable to the sheet loading portion and configured to regulate an end portion of the sheet loaded on the sheet loading portion.

Further, at least one aspect of this disclosure provides a sheet feeder including the above-described sheet loader, on which a sheet is loaded, and a sheet feeding body configured to feed the sheet loaded on the sheet loader.

Further, at least one aspect of this disclosure provides an image forming apparatus including an image forming device configured to form an image on a sheet, and the above-described sheet feeder configured to feed the sheet toward the image forming device.

Further, at least one aspect of this disclosure provides a sheet end position regulating device including a first contact body disposed movable on a sheet loading portion on which a sheet is loaded and configured to contact an end portion of the sheet, a fixing body disposed movable between a fixing position at which a position of the first contact body to the sheet loading portion is fixed and a releasing position at which the position of the first contact body is released, a biasing body configured to apply a biasing force and bias the first contact body, toward an end of the sheet, and a switching body configured to switch the biasing force applied by the biasing body between a force applying state in which the biasing force of the biasing body is applied to the end of the sheet via the first contact body and a force suspending state in which the biasing force of the biasing body is not applied to the end of the sheet via the first contact body. The switching body starts to switch to the force applying state after the fixing body has started to move when the fixing body moves from the releasing position to the fixing position. The switching body starts to switch to the force suspending state before the fixing body starts to move when the fixing body moves from the fixing position to the releasing position.

Further, at least one aspect of this disclosure provides a sheet loader including a sheet loading portion on which a sheet is loaded, and the above-described sheet end position regulating device disposed movable to the sheet loading portion and configured to regulate an end portion of the sheet loaded on the sheet loading portion.

Further, at least one aspect of this disclosure provides a sheet feeder including the above-described sheet loader, on which a sheet is loaded, and a sheet feeding body configured to feed the sheet loaded on the sheet loader.

Further, at least one aspect of this disclosure provides an image forming apparatus including an image forming device configured to form an image on a sheet, and the above-described sheet feeder configured to feed the sheet toward the image forming device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
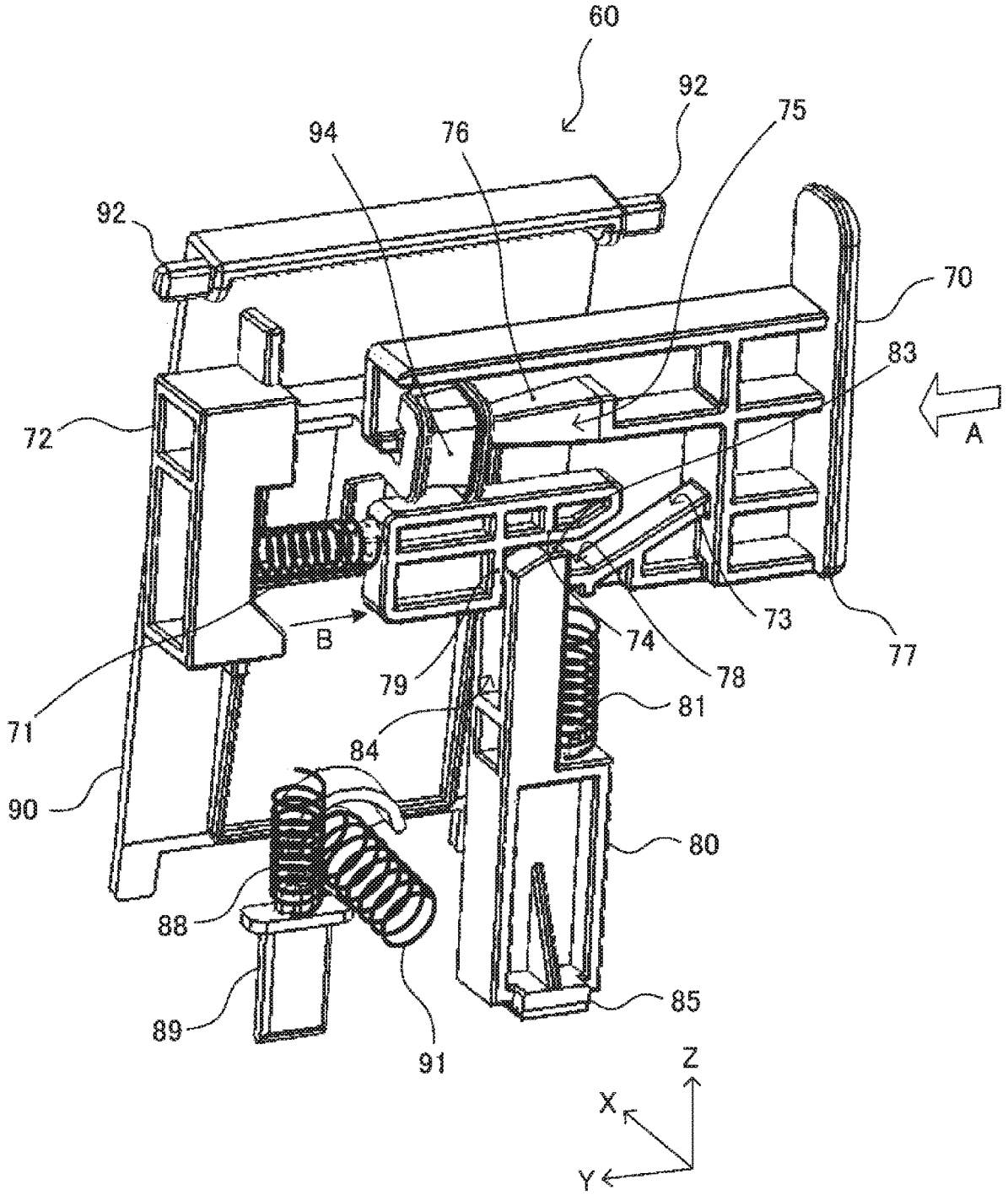
FIG. 1 is an enlarged perspective view illustrating an end fence in a fixed state and parts and components of the end fence other than a fence body frame.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner; and achieve a similar result.

Referring now to the drawings, wherein like reference numerals designate identical or corresponding parts throughout the several views, preferred embodiments of this disclosure are described.

Hereinafter, as an embodiment of an image forming apparatus to which this disclosure is applied, an electrophotographic image forming apparatus such as a printer that forms an image by an electrophotographic method will be described with reference to the drawings.

It is to be noted that identical parts are given identical reference numerals and redundant descriptions are summarized or omitted accordingly.

In the following description, the term "image forming apparatus" refers to an image forming apparatus that performs image formation by attaching developer or ink to a medium such as paper, OHP sheet, yarn, fiber, cloth, leather, metal, plastic, glass, wood, ceramics and the like.

Further, it is to be noted that the term "image formation" indicates an action for providing (i.e., printing) not only an image including texts and figures on a recording medium but also an image not including such as patterns on a recording medium.

The term "sheet" of the present embodiment includes paper, coated paper, OHP sheet, label paper, film, cloth and the like.

Further, the term "sheet" includes a resin sheet, a protective paper on the front and back faces, a metal sheet, an electronic circuit board material subject to metal foil plating such as a copper foil or electroplating, a special film, a plastic film, a prepreg, an electronic circuit substrate sheet, and the like. The prepreg is a sheet-like material in which carbon fiber or the like is previously impregnated with resin. As an example, the prepreg includes a sheet-like reinforced plastic molding material that is manufactured by, for example, impregnating a thermosetting resin, into which additives such as curative agent and coloring agent are mixed, in a fibrous reinforcing material such as a carbon fiber or a glass cloth, and then heating or drying to a semi-cured state.

It is to be noted that the term "sheet" is not limited to indicate a paper sheet but also includes a material which is called as a recording target medium, a recording medium, a recording sheet, or a recording paper, and is used to which the developer or ink is attracted. In addition, the term "sheet" is not limited to a flexible sheet but is applicable to a rigid plate-shaped sheet and a relatively thick sheet.

Further, in the following embodiments, size (dimension), material, shape, and relative positions used to describe each of the components and units are examples, and the scope of this disclosure is not limited thereto unless otherwise specified.

In the present embodiment, an electrophotographic printer will be described as an example of an image forming apparatus, but an image forming apparatus to which this disclosure is applicable is not limited thereto. Specifically, the image forming apparatus in the present embodiment is applicable to any of a copier, facsimile machine, printer, printing machine, inkjet recording device, and a multifunctional apparatus including at least two functions of the copier, facsimile machine, printer, printing machine, and inkjet recording device. Further, the image forming apparatus according to the present embodiment may also include an electrophotographic copier provided with an image reading device.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

First, a description is given of a basic configuration of the image forming apparatus 100 according to an embodiment of this disclosure.

Figure 2:
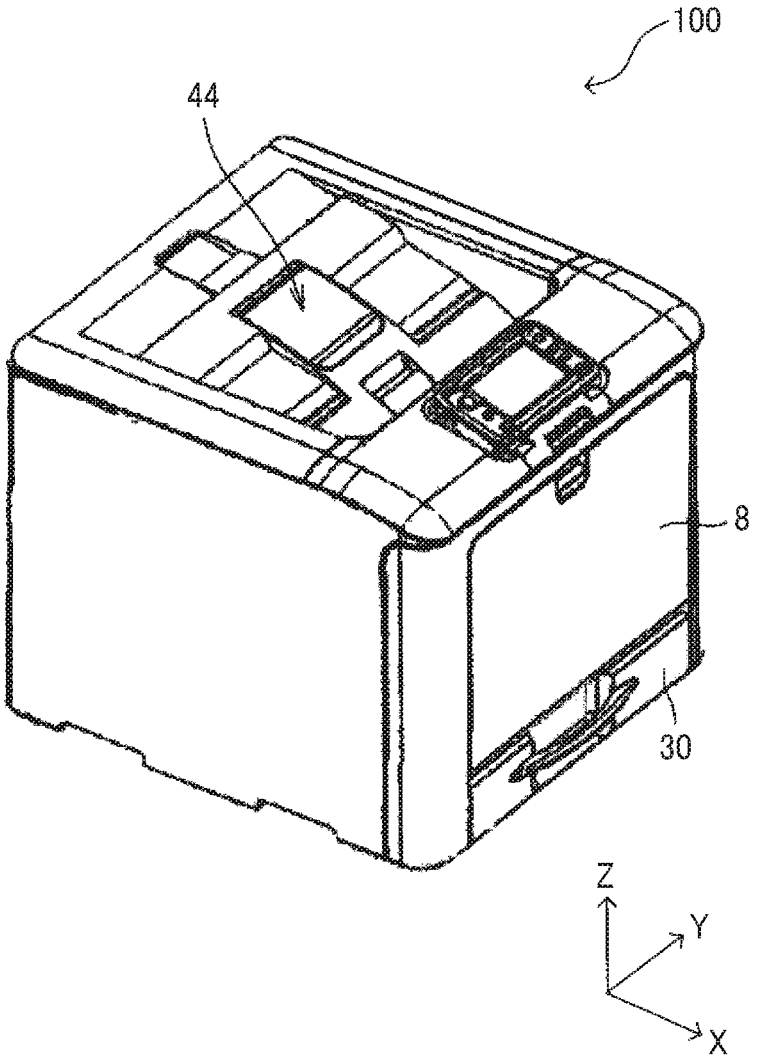
FIG. 2 is an external perspective view illustrating an image forming apparatus according to an embodiment of this disclosure.
Figure 3:
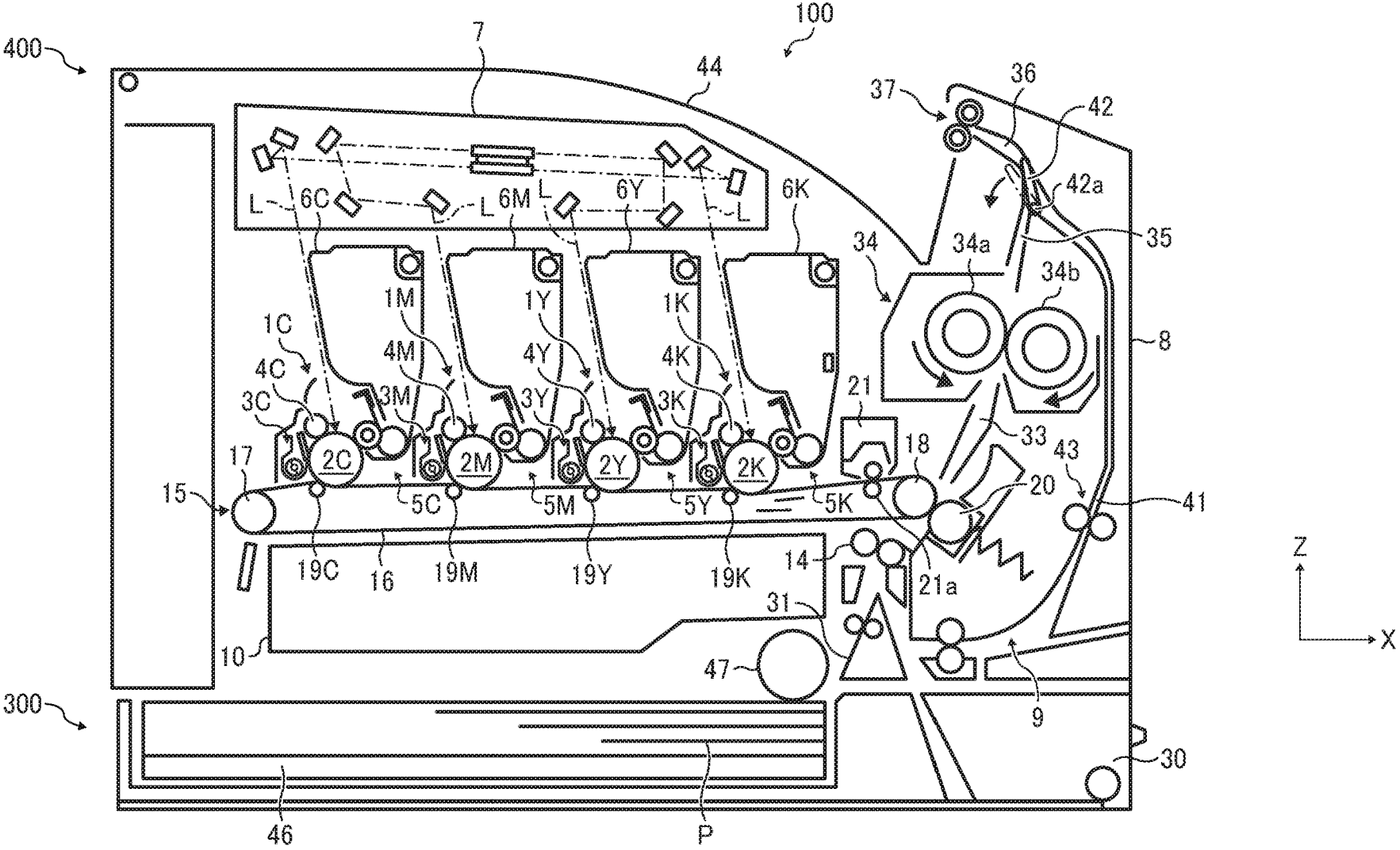
FIG. 3 is a diagram illustrating a schematic configuration of the image forming apparatus.

FIG. 2 is an external perspective view of an electrophotographic image forming apparatus 100 (hereinafter simply referred to as the image forming apparatus 100) according to the embodiment. FIG. 3 is a schematic configuration diagram of the image forming apparatus 100.

The image forming apparatus 100 is a color laser printer.

The image forming apparatus 100 includes an image forming device 400 and a sheet feeding device 300. The image forming device 400 forms an image on a sheet P that functions as a sheet, specifically, a sheet-like recording medium. The sheet feeding device 300 feeds the sheet P toward the image forming device 400.

The image forming device 400 includes four process units 1, that is, process units 1K, 1Y, 1M, and 1C. Suffixes K, Y, M, and C are used to indicate respective colors of the process units 1K, 1Y, 1M, and 1C (e.g., black, yellow, magenta, and cyan toners) of the image forming device 400. The process units 1K, 1Y, 1M, and 1C form respective single color images with the respective developers of black, yellow, magenta, and cyan, corresponding to components of color separation of a color image.

Each of the process units 1 (i.e., the process units 1K, 1Y, 1M, and 1C) has the configuration identical to each other, except that toners of different colors (i.e., black (K), yellow (Y), magenta (M), and cyan (C)) are used. Therefore, in the following description, suffixes K, Y, M, and C indicating the color of the toner to be used are appropriately omitted and occasionally described in a singular form when the configuration and functions of the process units 1K, 1Y, 1M, and 1C are explained.

The process unit 1 includes a drum-shaped photoconductor 2 (i.e., drum-shaped photoconductors 2K, 2Y 2M, and 2C) that functions as an image bearer (hereinafter, simply referred to as the "photoconductor 2"), a cleaning device 3 (i.e., cleaning devices 3K, 3Y, 3M, and 3C), a static eliminating device, a charging device 4 (i.e., charging devices 4K, 4Y; 4M, and 4C), and a developing device 5 (i.e., developing devices 5K, 5Y, 5M, and 5C). Each of the process units 1 is detachably attachable to an apparatus body of the image forming apparatus 100. Consumable parts of the process unit 1 can be replaced at one time.

An optical writing device 7 is disposed above the four process units 1 of the image forming apparatus 100. The optical writing device 7 is configured to emit a laser beam from laser diodes disposed therein based on image data.

A transfer device 15 is disposed below the four process units 1 of the image forming apparatus 100. The transfer device 15 includes four primary transfer rollers 19 (i.e., primary transfer rollers 19K, 19Y, 19M, and 19C) and an intermediate transfer belt 16. The primary transfer rollers 19K, 19Y, 19M, and 19C correspond to respective toner colors of the process units 1K, 1Y, 1M, and 1C. The four primary transfer rollers 19K, 19Y, 19M, and 19C are disposed at the respective opposing positions of the photoconductors 2K, 2Y, 2M, and 2C with the intermediate transfer belt 16 interposed therebetween. The primary transfer rollers 19K, 19Y, 19M, and 19C are disposed in contact with an inner circumferential surface of the loop of the intermediate transfer belt 16.

The intermediate transfer belt 16 is an endless belt that is entrained around the primary transfer rollers 19K, 19Y, 19M, and 19C, a drive roller 18, and a driven roller 17.

A secondary transfer roller 20 is disposed facing the drive roller 18 with the intermediate transfer belt 16 interposed therebetween while pressing an outer circumferential surface of the intermediate transfer belt 16. Thus, a secondary transfer nip region is formed at a position at which the secondary transfer roller 20 and the intermediate transfer belt 16 contact each other. A belt cleaning device 21 is disposed downstream from the secondary transfer roller 20 in a belt moving direction of the intermediate transfer belt 16. A cleaning backup roller 21*a* is disposed facing the belt cleaning device 21 with the intermediate transfer belt 16 interposed therebetween.

As illustrated in FIG. 2, the sheet feeding device 300 is disposed at a lower part of the image forming apparatus 100. The sheet feeding device 300 includes a sheet feed tray 30 and a sheet feed roller 47. The sheet feed tray 30 is a sheet feed tray on which a large number of sheets can be loaded in a sheet bundle. The sheet feed tray 30 is detachably attachable to the apparatus body of the image forming apparatus 100 in order to replenish the sheets P. The sheet feed roller 47 is disposed above the sheet feed tray 30 in a state in which the sheet feed tray 30 is set in the apparatus body of the image forming apparatus 100, as illustrated in FIG. 2. In this state, a sheet P is fed from the sheet feed tray 30 toward a sheet conveyance passage 31.

A pair of registration rollers 14 is disposed upstream from the secondary transfer roller 20 in a sheet conveying direction of the sheet P. The pair of registration rollers 14 includes two rollers that forms a registration nip region therebetween. The sheet P that is fed from the sheet feed tray 30 contacts the registration nip region and stops temporarily. By stopping the sheet P temporarily at the registration nip region of the pair of registration rollers 14, the sheet P is sagged at the leading end thereof.

The sheet P on which the slack is formed is fed out toward the secondary transfer nip in synchronization at a timing at which a toner image on the intermediate transfer belt 16 reaches the secondary transfer nip region. The toner image formed on the intermediate transfer belt 16 is transferred onto the sheet P conveyed from the pair of registration rollers 14 at the secondary transfer nip region.

A post-transfer sheet conveyance passage 33 is provided above the secondary transfer nip region and a fixing device 34 is located at a position close to the upper end of the post-transfer sheet conveyance passage 33.

The fixing device 34 includes a fixing roller 34*a* and a pressure roller 34*b*. The fixing roller 34*a* includes a heat generating source such as a halogen lamp. The pressure roller 34*b* rotates while contacting the fixing roller 34*a* with a predetermined pressure.

A post-fixing sheet conveyance passage 35 is provided above the fixing device 34 and is branched at a branching portion that is at the upper end of the post-fixing sheet conveyance passage 35 into a sheet output passage 36 and a switchback sheet conveyance passage 41.

A switching member 42 is disposed at the branching portion and is swingably driven about a swing shaft 42*a*. A pair of sheet output rollers 37 is disposed at a position close to an opening end of the sheet output passage 36.

A pair of switchback conveying rollers 43 is disposed in the middle of the switchback sheet conveyance passage 41. The downstream end of the switchback sheet conveyance passage 41 in the sheet conveying direction meets and merges the sheet conveyance passage 31. A sheet output tray 44 is formed on top of the image forming apparatus 100 in a shape recessed inwardly.

A waste toner container 10 that functions as a powder container is disposed detachably attached to the apparatus body of the image forming apparatus 100 and provided between the transfer device 15 and the sheet feed tray 30.

A transfer cover 8 is disposed above the sheet feed tray 30 and on a front side in a drawing direction of the sheet feed tray 30 (i.e., the tight side in FIG. 3). By opening the transfer cover 8, the inside of the image forming apparatus 100 can be inspected. The transfer cover 8 includes a bypass sheet feed roller and a bypass sheet feed tray. A sheet loaded on the bypass sheet feed tray is fed by the bypass sheet feed roller toward the inside of the image forming apparatus 100.

Next, a description is given of basic operations of the image forming apparatus 100, with reference to FIG. 3.

First, the operation of a single-side printing is described.

The sheet feed roller 47 rotates in response to receipt of a sheet feed signal sent from a controller of the image forming apparatus 100, so that an uppermost sheet P that is placed on top of the sheet bundle of sheets P loaded on the sheet feed tray 30 is separated from the other sheets P of the sheet bundle and is conveyed toward the sheet conveyance passage 31.

When the leading end of the sheet P fed by the sheet feed roller 47 reaches the registration nip region of the pair of registration rollers 14, the sheet P forms the slack and temporarily stops.

When the sheet P is fed from the bypass sheet feed tray, the sheets P of the sheet bundle loaded on the bypass sheet feed tray are fed one by one starting from the uppermost sheet P placed on top of the sheet bundle by the bypass sheet feed roller. Then, the sheet P passes part of the switchback sheet conveyance passage 41 to be conveyed to the registration nip region of the pair of registration rollers 14 and stops temporarily. The subsequent operations are the same operations as the sheet feeding operations from the sheet feed tray 30.

In the image forming device 400, the charging device 4 of the process unit 1 uniformly charges the surface of the photoconductor 2 to high potential.

The optical writing device 7 emits a laser light beam L based on image data to the photoconductor 2 having the charged surface. As the optical writing device 7 irradiates the surface of the photoconductor 2, the potential in the irradiated area on the surface of the photoconductor 2 decreases to form an electrostatic latent image.

The developing device 5 supplies toner supplied from a toner bottle 6 (i.e., toner bottles 6K, 6Y, 6M, and 6C) to the surface of the photoconductor 2 on which the electrostatic latent image is formed, so that a toner image of each color is formed (developed) on the surface of the photoconductor 2. The toner image formed on the photoconductor 2 is transferred onto the intermediate transfer belt 16 by the primary transfer roller 19.

After the intermediate transfer process, residual toner remaining on the surface of the photoconductor 2 is removed by the cleaning device 3. The removed residual toner is conveyed by a waste toner conveying unit to be collected to the waste toner container 10. Residual charge remaining on the surface of the photoconductor 2 after removal of the residual toner by the cleaning device 3 is electrically discharged and removed by the static eliminator.

In the process units 1 (i.e., the process units 1K, 1Y, 1M, and 1C) of each color, toner images are formed on the surfaces of the photoconductors 2 (i.e., the photoconductors 2K, 2Y, 2M, and 2C) of the respective colors through the above-described processes, and the toner images of the respective colors are transferred and overlapped one another onto the intermediate transfer belt 16.

After the respective toner images of the respective colors are transferred and overlapped on cone another, onto the intermediate transfer belt 16, when the composite toner image reaches the secondary transfer nip region, the toner image is transferred onto the sheet P that is fed from the pair of registration rollers 14 by the secondary transfer roller 20.

The sheet P onto which the toner image is transferred is conveyed to the fixing device 34 through the post-transfer sheet conveyance passage 33. When the sheet P is conveyed to the fixing device 34, an unfixed toner image formed on the sheet P is fixed to the sheet P by application of heat and pressure. The sheet P having the fixed toner image is conveyed from the fixing device 34 to the post-fixing sheet conveyance passage 35.

The sheet P conveyed from the fixing device 34 is conveyed to the sheet output passage 36 via the post-fixing sheet conveyance passage 35. The pair of sheet output rollers 37 holds the sheet P that is conveyed to the sheet output passage 36 and rotates to output the sheet P to the sheet output tray 44. After performing the above-described operations, the single-side printing operation is completed.

Next, a description is given of basic operations of a duplex or double-sided printing.

Similar to the single-side printing operation, the sheet P is conveyed from the fixing device 34 to the sheet output passage 36.

Then, when the duplex printing operation is performed, the pair of sheet output rollers 37 is driven and rotated to convey part of the sheet P to the outside of the apparatus body of the image forming apparatus IOC. When the trailing end of the sheet P passes through the sheet output passage 36, the switching member 42 swings about the swing shaft 42*a* as indicated by a broken line in FIG. 3, and then the upper end of the post-fixing sheet conveyance passage 35 is closed. Then, at the substantially same time as the closure of the upper end of the post-fixing sheet conveyance passage 35, the pair of sheet output rollers 37 rotates in a direction opposite the sheet conveying direction to discharge the sheet P to the outside of the apparatus body of the image forming apparatus 100, so that the sheet P is conveyed to the switchback sheet conveyance passage 41.

When the trailing end of the sheet P passes the position of the switching member 42, the switching member 42 swings about the swing shaft 42*a* as indicated by a solid line of FIG. 3, and then the upper end of the post-fixing sheet conveyance passage 35 is opened to guide the sheet P that has passed through the post-fixing sheet conveyance passage 35 to the sheet output passage 36.

The sheet P fed to the switchback sheet conveyance passage 41 passes the pair of switchback conveying rollers 43 and reaches the pair of registration rollers 14. Similar to the one side of the sheet P is performed, the sheet P having reached the pair of registration rollers 14 is conveyed to the secondary transfer nip region in synchronization with the timing at which the toner image formed on the intermediate transfer belt 16 reaches the secondary transfer nip region. Thereafter, similar to the operation of the single-side printing, the toner image is transferred onto the sheet P in the secondary transfer nip region and is fixed to the sheet P in the fixing device 34, and the sheet P is output to the sheet output tray 44. After performing the above-described operations, the duplex printing operation is completed.

After the toner image formed on the intermediate transfer belt 16 has been transferred onto the sheet P, residual toner remains on the intermediate transfer belt 16. The residual toner is removed from the intermediate transfer belt 16 by the belt cleaning device 21. The residual toner removed from the intermediate transfer belt 16 is conveyed to the waste toner container 10 by the waste toner conveying unit and collected in the waste toner container 10.

Figure 4:
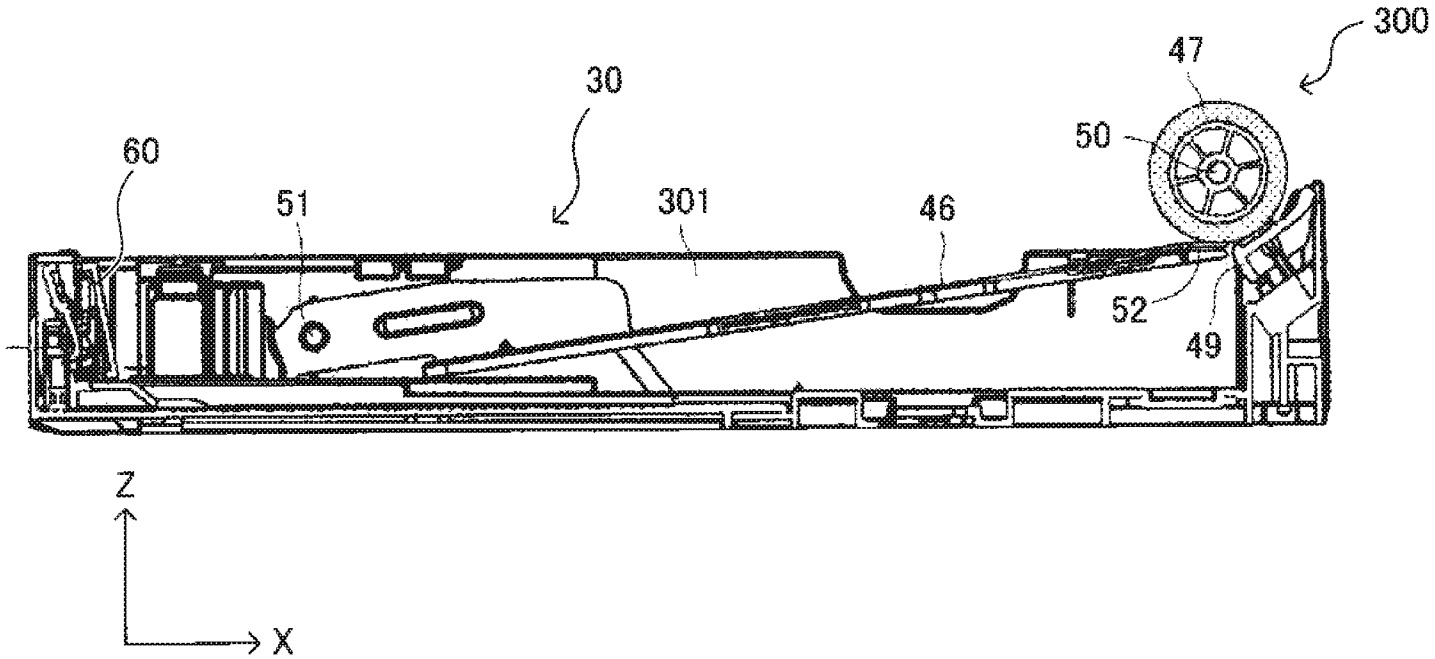
FIG. 4 is a side cross-sectional view illustrating a sheet feeding device included in the image forming apparatus.
Figure 5:
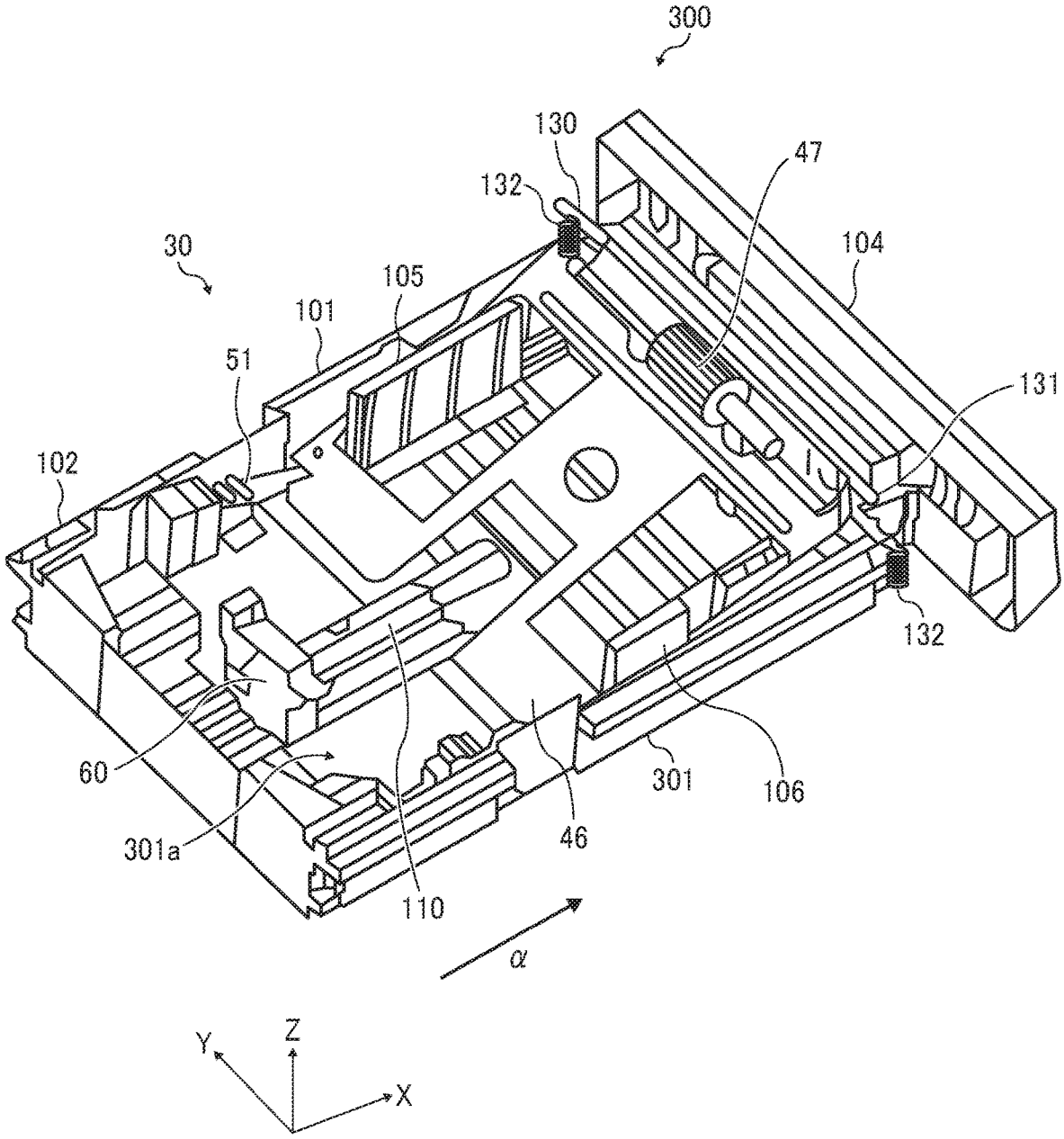
FIG. 5 is a perspective view illustrating the sheet feeding device.

Next, a description is given of the sheet feeding device 300, with reference to FIGS. 4 and 5.

Figure 6:
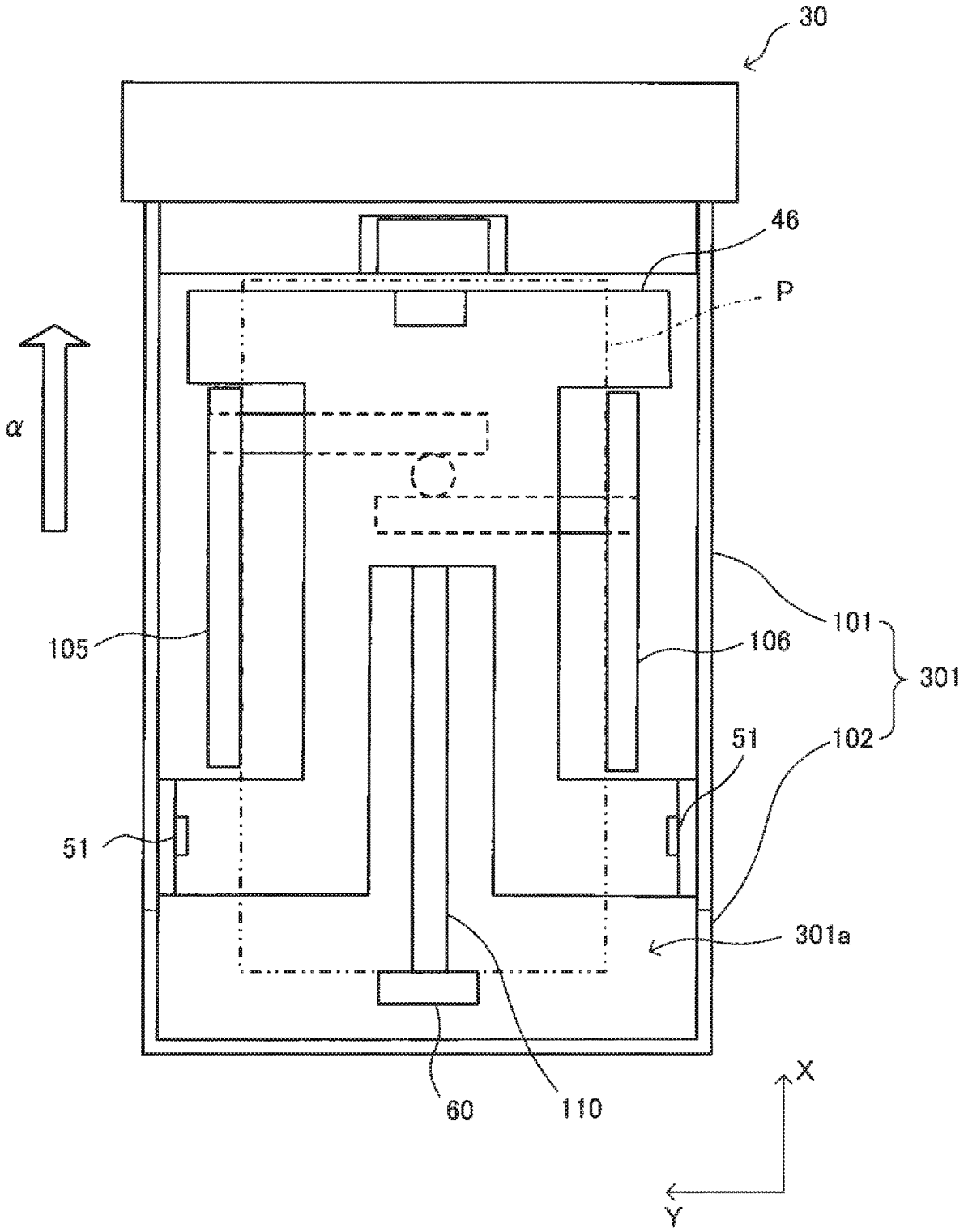
FIG. 6 is a top view illustrating a sheet feed tray provided to the sheet feeding device.

FIG. 4 is a side cross-sectional view illustrating the sheet feeding device 300 included in the image forming apparatus 100. FIG. 5 is a perspective view illustrating the sheet feeding device 300. FIG. 4 illustrates a state in which a front panel 104 is removed from the sheet teed tray 30. FIG. 6 is a top view illustrating the sheet feed tray 30 provided to the sheet feeding device 300.

The sheet feeding device 300 is a sheet feeding device that employs a separation pad.

The sheet feed roller 47 illustrated in FIGS. 4 and 5 is disposed on the side of the apparatus body of the image forming apparatus 100. Further, the sheet feed tray 30 includes a bottom plate 46 and a receiving table 49.

The sheet feed tray 30 includes a tray front portion 101 and a tray rear portion 102 that form a tray housing 301 having a bottom face 301*a* that functions as a sheet loading portion on which the sheet P is loaded. The tray rear portion 102 is movable to the tray front portion 101 in a direction parallel to the sheet conveying direction (in a direction indicated by arrow "α" in FIG. 5) and is changeable in the size in the sheet conveying direction of the sheet feed tray 30. An end fence 60 that contacts the trailing end of the sheet P in the sheet conveying direction and regulates the position of the trailing end of the sheet P. The tray rear portion 102 includes a rail groove 110 that extends in a direction parallel to the sheet conveying direction and the lower part of the end fence 60 (i.e., an end fence engaging portion 62 that is described below) engages with the rail groove 110. By engaging with the rail groove 110, the end fence 60 is slidable in the direction parallel to the sheet conveying direction along the rail groove 110. Accordingly, the rail groove 110 functions as a guide to guide the end fence 60 in a predetermined direction (e.g., an X-axis direction).

Since the size of the sheet feed tray 30 in the sheet conveying direction is changeable, the sheets having different sizes in the sheet conveying direction are stored in the sheet feed tray 30 while the trailing end of each of the sheets P having different sizes in the sheet conveying direction is reregulated by the end fence 60.

In the sheet feed tray 30, a right side fence 105 and a left side fence 106, which are lateral position fixing members, are disposed on the tray front portion 101 to be slidable in a direction perpendicular to the sheet conveying direction. In the sheet feed tray 30, the position in the width direction of the sheet P contained in the sheet feed tray 30 is regulated by the right side fence 105 and the left side fence 106, and the position of the trailing end of the sheet P is regulated by the end fence 60. Accordingly, the position of the sheet P in the sheet feed tray 30 is regulated.

As illustrated in FIG. 5, a right lever 130 and a left lever 131 are rotatably (swingably) attached to the tray front portion 101. The respective upper ends of two bottom plate springs 132 are attached to the right lever 130 and the left lever 131. The lower ends of the two bottom plate springs 132 are attached (hooked) to the bottom plate 46.

The sheet feed roller 47 is prevented from rotating by the sheet feed roller shaft 50 and a D-shaped cut portion or a pin and is supported by the apparatus body of the image forming apparatus 100 via a bearing.

The sheet feed roller shaft 50 is extended in a vertical direction to the drawing sheet of FIG. 4 (hereinafter, referred to as a width direction). A drive gear is mounted on a shaft end of the sheet feed roller shaft 50.

The drive gear is coupled to a drive source such as a motor via a drive connecting member such as a plurality of idler gears, clutches, or solenoids. Then, a driving force is transmitted from the drive source to the sheet feed roller shaft 50, and the sheet feed roller 47 rotates in a counterclockwise direction.

By controlling the connecting time of the above-described drive connecting member and the stop time of the drive source, the sheet feed roller 47 operates intermittently at a predetermined timing.

The sheet feed roller 47 has a surface layer including rubber material of high coefficient of friction, such that a predetermined conveying force is applied to the sheet P. Then, the sheet P is fed by controlling the connecting time of the drive connecting member and the stop time of the drive source.

The dimension of the sheet feed roller 47 are, for example, a diameter of 36 mm and a width of 45 mm. An appropriate size of the sheet feed roller 47 is selected according to the type of the sheet P that is to be handled by the sheet feeding device 300 and the space within the sheet feeding device 300.

The bottom plate 46 of the sheet feed tray 30 is rotatably supported by a bottom plate rotary shaft 51 that is provided to the sheet feed tray 30. The bottom plate 46 is constantly biased upwardly by the two bottom plate springs 132, with the respective upper ends of the two bottom plate springs 132 being fixed to the right lever 130 and the left lever 131.

The tray housing 301 includes the bottom face 301*a* that functions as a sheet loader on which the sheet P is loaded.

When the sheet P is stored in the sheet feed tray 30, the sheet feed tray 30 is pulled out from the apparatus body of the image forming apparatus 100 and the sheet P is loaded on the bottom face 301*a*. At this time, the leading end of the sheet P in the sheet conveying direction is held by the upper face of the bottom plate 46.

When the sheet feed tray 30 with the sheet P is loaded thereon is inserted into the apparatus body of the image forming apparatus 100, the right lever 130 and the left lever 131 are lifted upwardly and held by a lever guide provided to the apparatus body of the image forming apparatus 100. With this operation, the respective upper ends of the two bottom plate springs 132 respectively mounted on the right lever 130 and the left lever 131 are lifted upwardly, and the bottom plate springs 132 are extended, so that the bottom plate 46 is lifted upwardly by the biasing force of the extended bottom plate springs 132. Accordingly, the upper face of the sheet P that is pushed up to the bottom plate 46 is pressed and contacted to the sheet feed roller 47 that is attached to the apparatus body of the image forming apparatus 100.

As the sheet bundle of sheets P is contained in the sheet feed tray 30 and the sheet feed tray 30 is inserted into the apparatus body of the image forming apparatus 100, the uppermost sheet P contacts the sheet feed roller 47. By the frictional force generated between the sheet P and the sheet feed roller 47, the conveying force is applied when the sheet feed roller 47 rotates, and the sheet P is conveyed in a direction to the right side of FIG. 4 (that is, a direction indicated by "α" in FIGS. 5 and 6).

A pad that is a pad member of high coefficient of friction is provided to the receiving table 49. The pad forms a separating portion at which the uppermost sheet is separated from the sheets P other than the uppermost sheet P by blocking movement of the sheets P other than the uppermost sheet P in the sheet conveying direction by the pad, so that the uppermost sheet P alone is conveyed. When the sheet P is conveyed along with rotation of the sheet feed roller 47, the uppermost sheet is separated from the other sheets P at the separating portion. Accordingly, the uppermost sheet P alone is separated and conveyed toward the downstream side from the separating portion in the sheet conveying direction by the sheet feed roller 47.

As illustrated in FIG. 4, a bottom plate pad 52 that is a pad member of high coefficient of friction is disposed at the leading end of the bottom plate 46 in the sheet conveying direction. The bottom plate pad 52 applies a constant load to a lowermost sheet P of the sheet bundle loaded on the sheet feed tray 30. With this configuration, when the sheet bundle of sheets P is loaded on the sheet feed tray 30, the lowermost sheet P is prevented from being conveyed together with a second lowermost sheet P, in other words, multifeeding is prevented.

Next, a description is given of the end fence 60.

Figure 7:
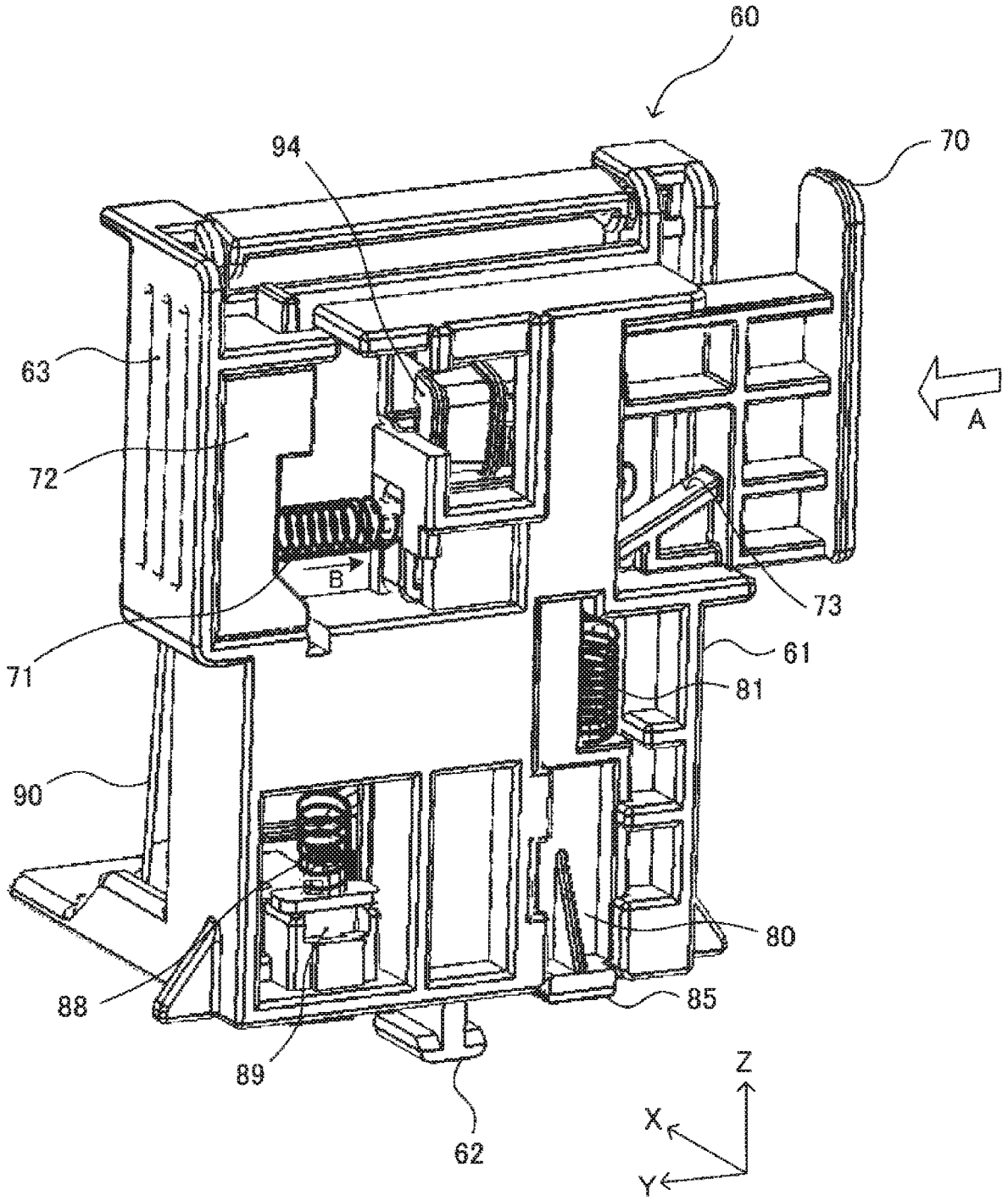
FIG. 7 is a perspective enlarged view illustrating the end fence in the fixed state, viewed from a rear end side of the sheet feed tray.

FIG. 7 is an enlarged perspective view illustrating the end fence 60 in the fixed state to the tray housing 301, viewed from the rear end side of the sheet feed tray 30.

The end fence 60 includes a fence body frame 61, a fixing claw 80, and a trailing end contact plate 90. The fixing claw 80 functions as a fixing body to fix the fence body frame 61 to the tray housing 301. The trailing end contact plate 90 contacts the trailing end of the sheet P that is loaded on the sheet feed tray 30. FIG. 1 is an enlarged perspective view illustrating parts of the end fence 60 of FIG. 7, other than the fence body frame 61. In other words, the fence body frame 61 is not illustrated in the end fence 60 of FIG. 1.

The fixing claw 80 fixes the end fence 60 at an arbitrary position on the rail groove 110. By so doing, the position of the end fence 60 with respect to the bottom face 301*a* is fixed, so that the position of the trailing end contact plate 90 of the end fence 60 to the bottom face 301*a* is fixed. The trailing end contact plate 90 contacts the trailing end of the sheet in a state in which the position of the trailing end contact plate 90 to the bottom face 301*a* is fixed by the fixing claw 80. Accordingly, the trailing end contact plate 90 includes a function to regulate the position of the trailing end of the sheet P and a function to press the trailing end of the sheet P toward the downstream side in the sheet conveying direction.

Figure 8:
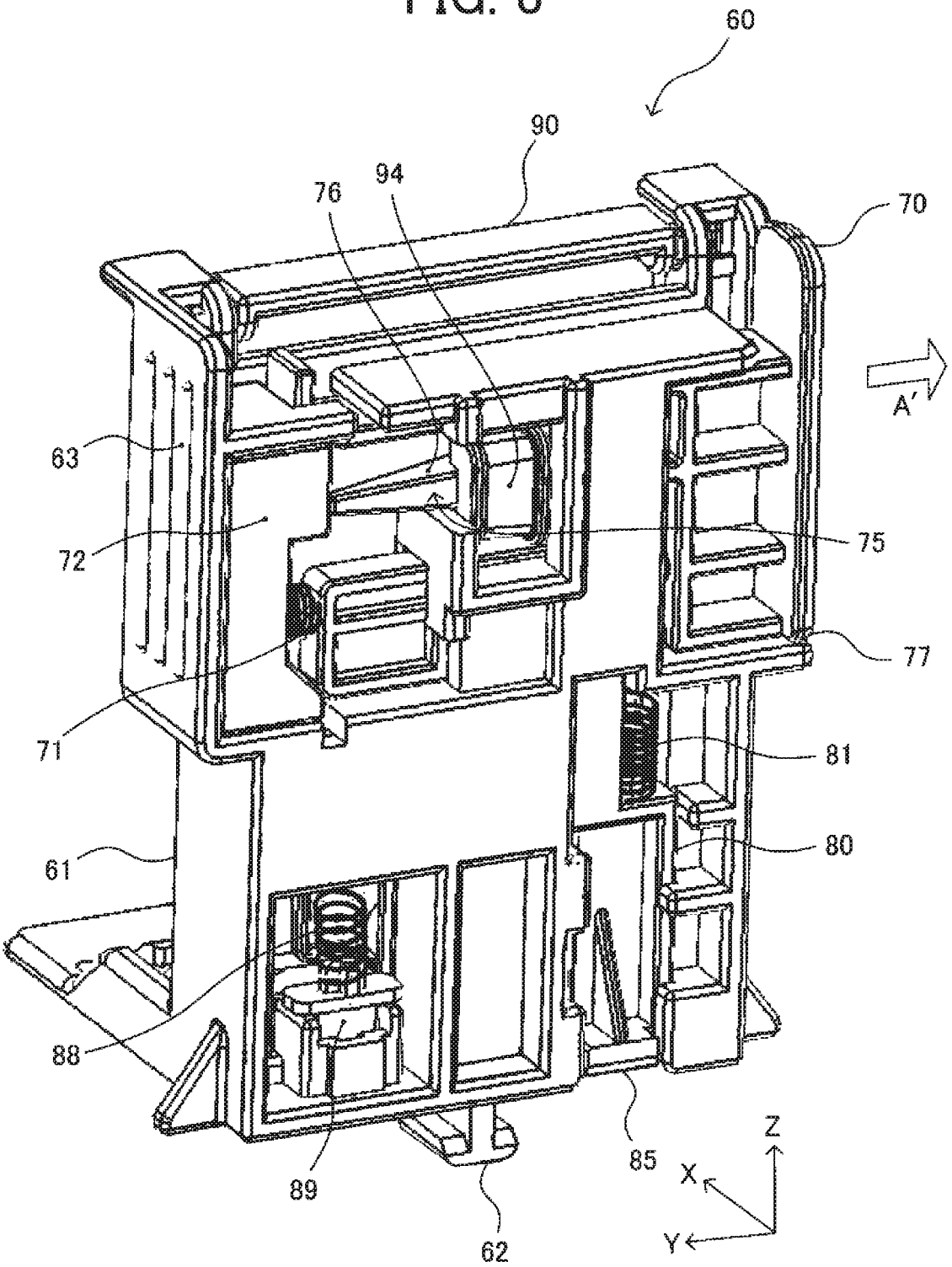
FIG. 8 is a perspective enlarged view illustrating the end fence in a released state from the fixed state of FIG. 7, by pressing a releasing button.
Figure 9:
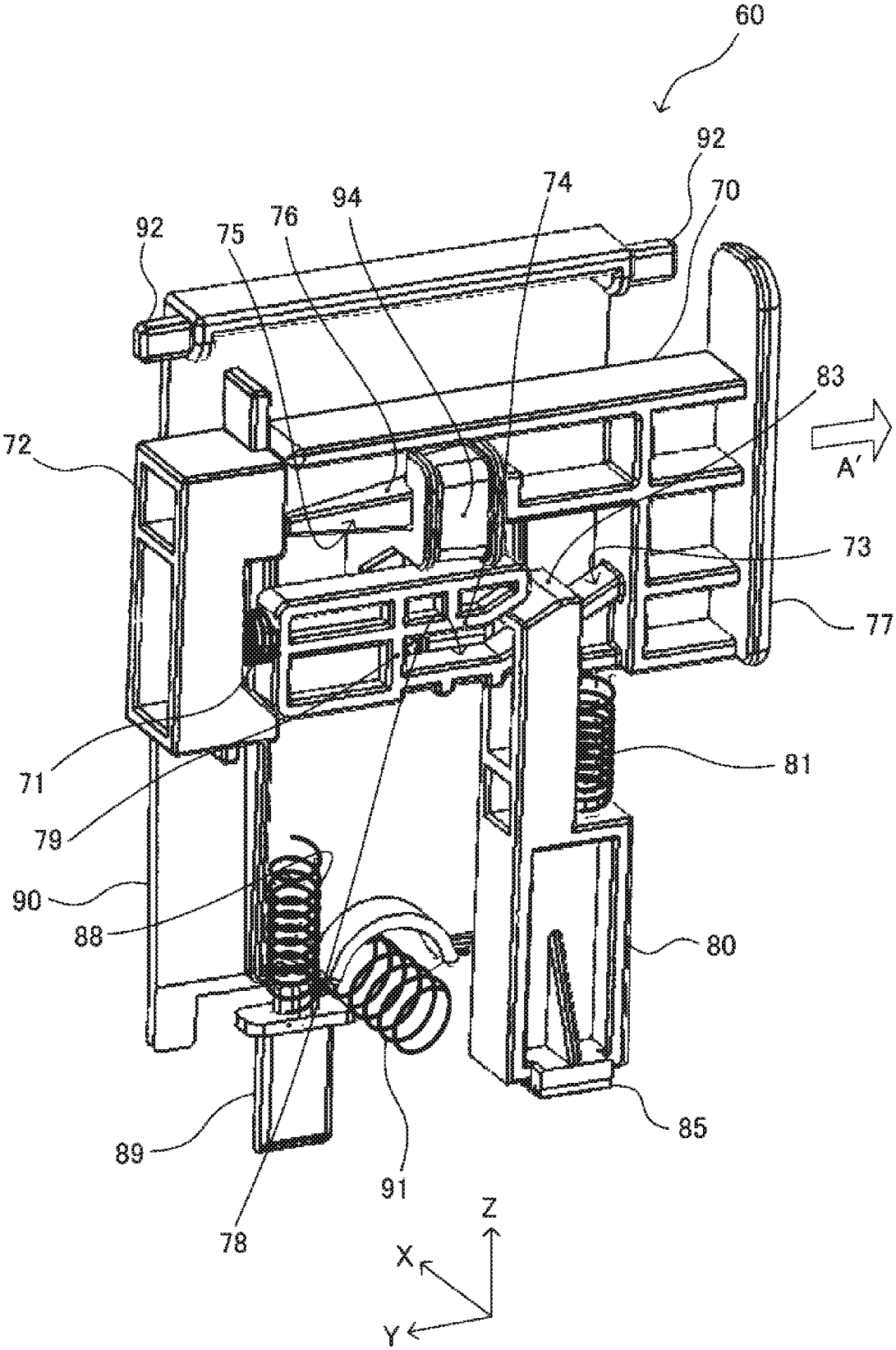
FIG. 9 is an enlarged perspective view illustrating the end fence of FIG. 8 and parts and components of the end fence other than the fence body frame.

FIG. 8 is a perspective enlarged view illustrating the end fence 60, viewed from the same angle in FIG. 7, in a released state with respect to the tray housing 301 by pressing a releasing button 70 of the end fence 60 of FIG. 7. FIG. 9 is an enlarged perspective view illustrating parts of the end fence 60 of FIG. 8, other than the fence body frame 61.

Figure 10:
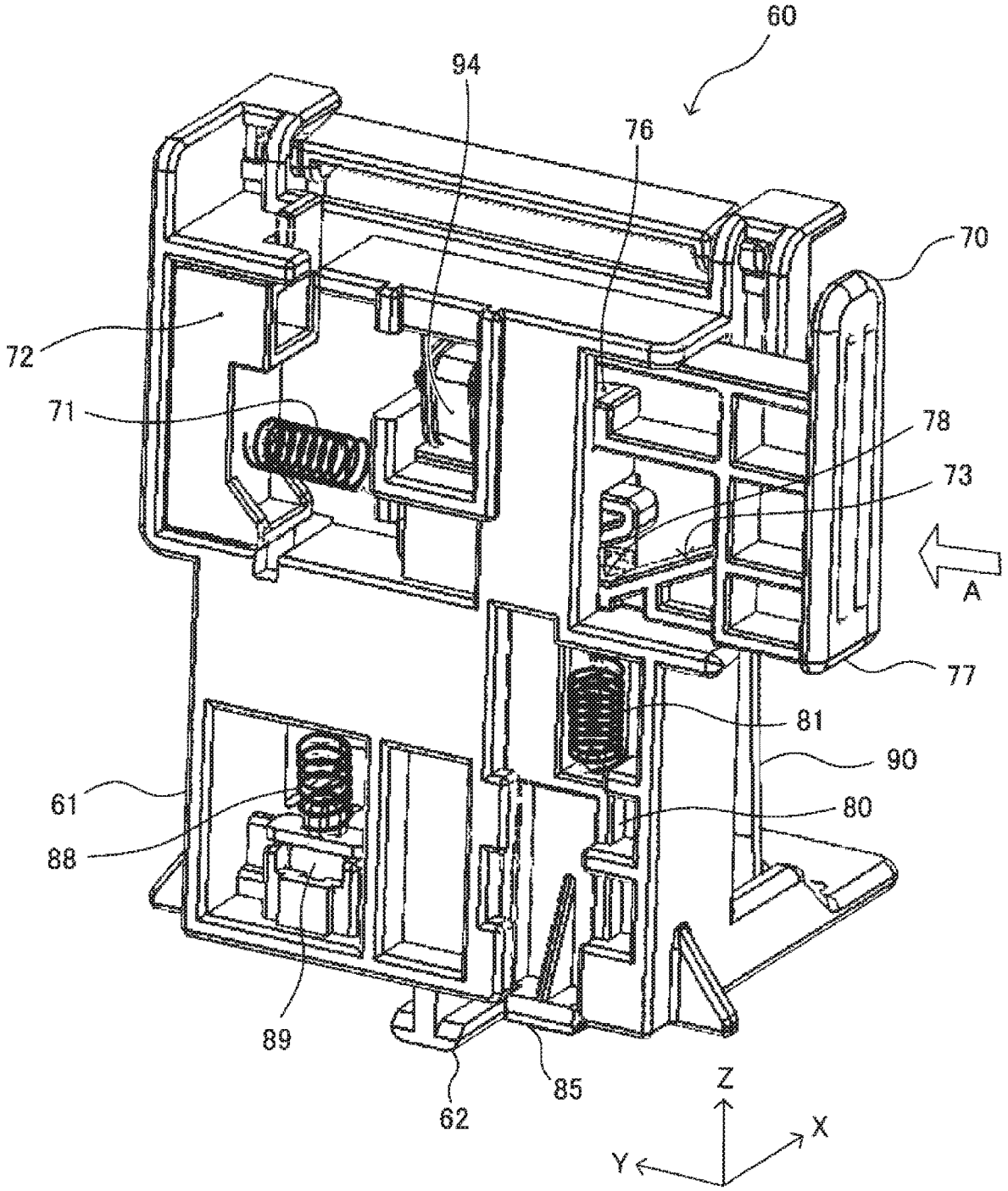
FIG. 10 is an enlarged perspective view illustrating the end fence in the fixed state, viewed from a different angle from the end fence in the fixed state of FIG. 7.
Figure 11:
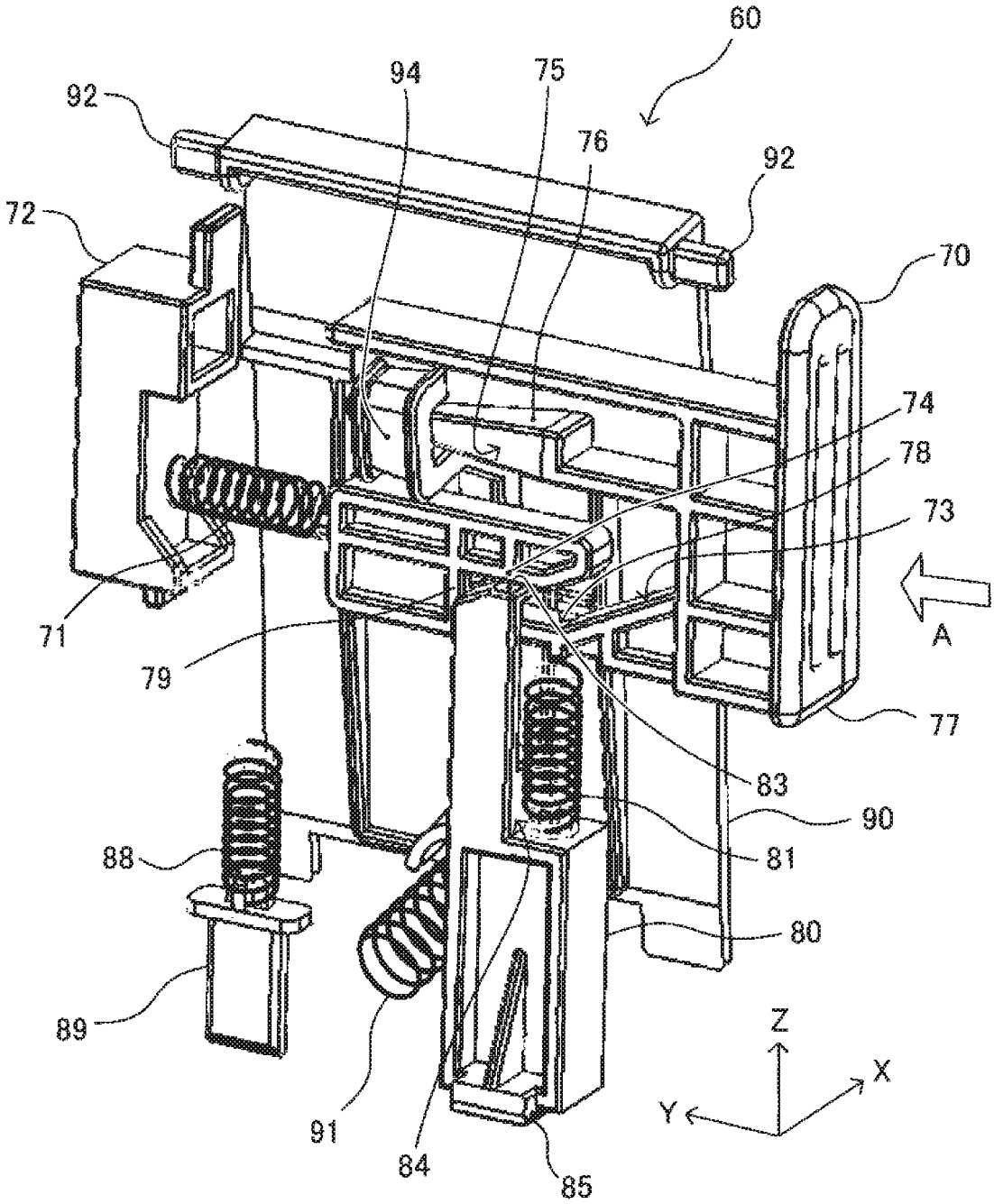
FIG. 11 is an enlarged perspective view illustrating the end fence of FIG. 10 and parts and components of the end fence other than the fence body frame.

FIG. 10 is an enlarged perspective view illustrating the end fence 60 in the fixed state of FIG. 7, viewed from a different angle from FIG. 7. FIG. 11 is an enlarged perspective view illustrating parts of the end fence 60 of FIG. 10, other than the fence body frame 61.

Figure 12:
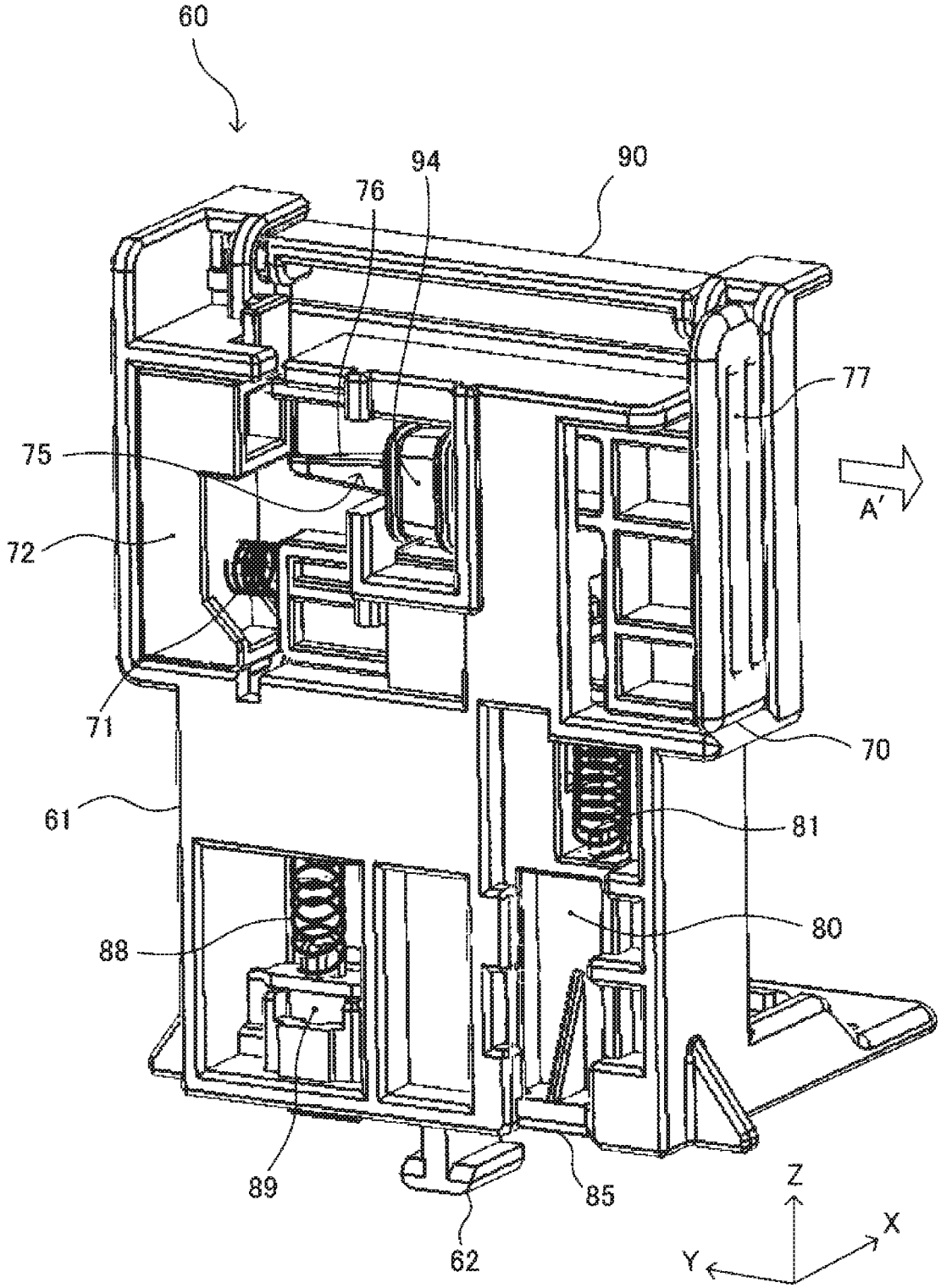
FIG. 12 is an enlarged perspective view illustrating the end fence in the released state, viewed from the same angle as the end fence in the released state of FIG. 10.
Figure 13:
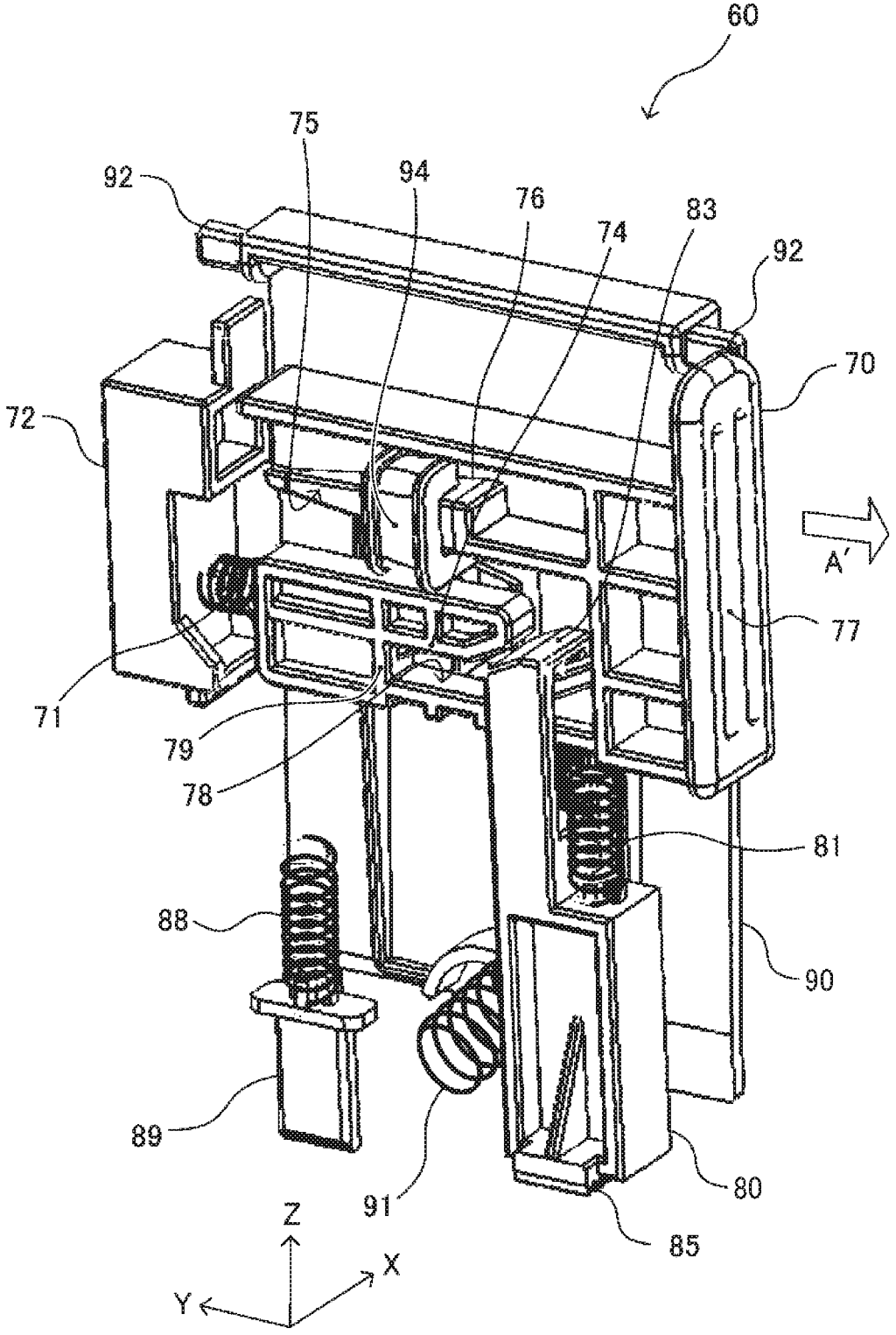
FIG. 13 is an enlarged perspective view illustrating the end fence of FIG. 12 and parts and components of the end fence other than the fence body frame.

FIG. 12 is an enlarged perspective view illustrating the end fence 60 in the released state of FIG. 8, viewed from the same angle as FIG. 10. FIG. 13 is an enlarged perspective view illustrating parts of the end fence 60 of FIG. 12, other than the fence body frame 61.

The end fence 60 is provided with the releasing button 70. The releasing button 70 is pressed in a direction indicated by arrow A in FIGS. 1 and 7, is slidably moved to the fence body frame 61, and releases the end fence 60 from the fixing claw 80.

The releasing button 70 is held to be slidable in the width direction (i.e., a Y-axis direction in the drawings) to the fence body frame 61 and the relative movement of the releasing button 70 to the other directions is regulated and prevented by the shape of the fence body frame 61.

The end fence 60 includes a releasing button biasing spring 71 that applies a biasing force to the releasing button 70 in a direction opposite the pressing direction (i.e., a direction indicated by arrow B in FIGS. 1 and 7). One end (i.e., the right end in FIGS. 1 and 7) of the releasing button biasing spring 71 contacts the side face of the releasing button 70 and the other end of the releasing button biasing spring 71 contacts a button biasing spring contact member 72 that is fixed to the fence body frame 61.

As illustrated in FIG. 1, in a state in which the releasing button 70 is not pressed, the releasing button 70 is biased by the releasing button biasing spring 71 in the direction indicated by arrow B in FIG. 1, and a button side contact portion 79 that is part of the releasing button 70 contacts the side face of the fixing claw 80. The fixing claw 80 is regulated from moving in the Y-axis direction to the fence body frame 61, and therefore, when the releasing button 70 that is biased by the releasing button biasing spring 71 contacts the side face of the fixing claw 80, the releasing button 70 in the Y-axis direction is positioned.

Figure 14:
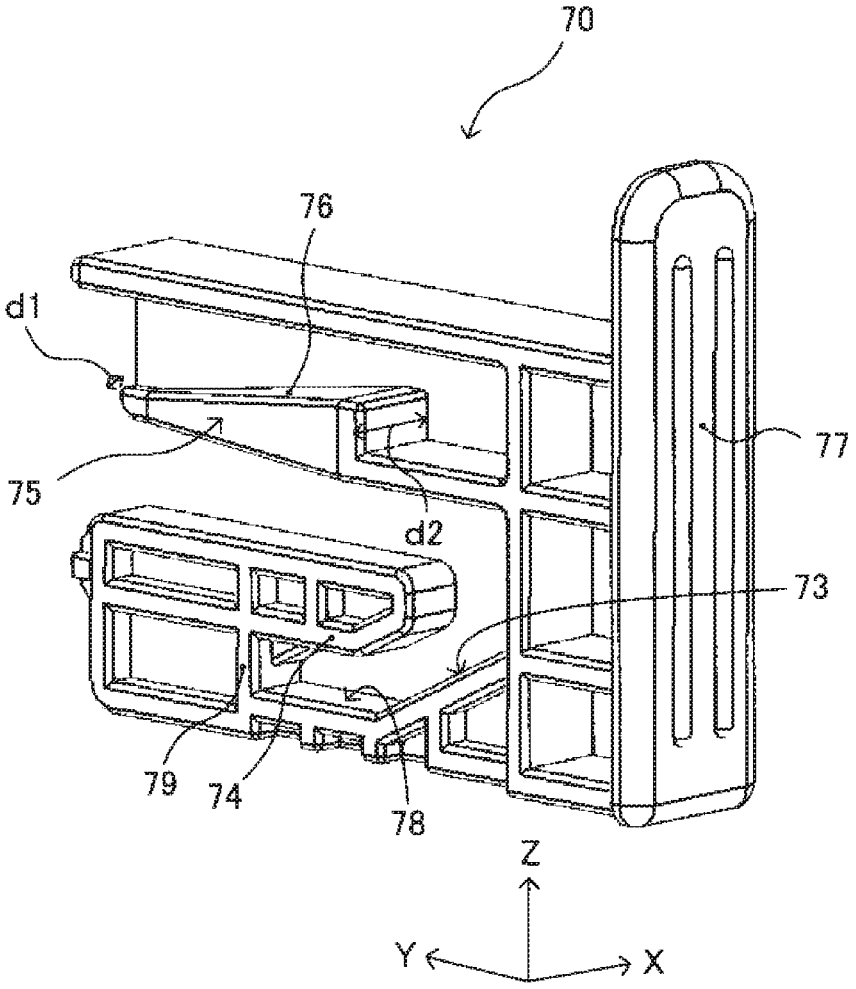
FIG. 14 is a perspective view illustrating the releasing button.
Figure 15:
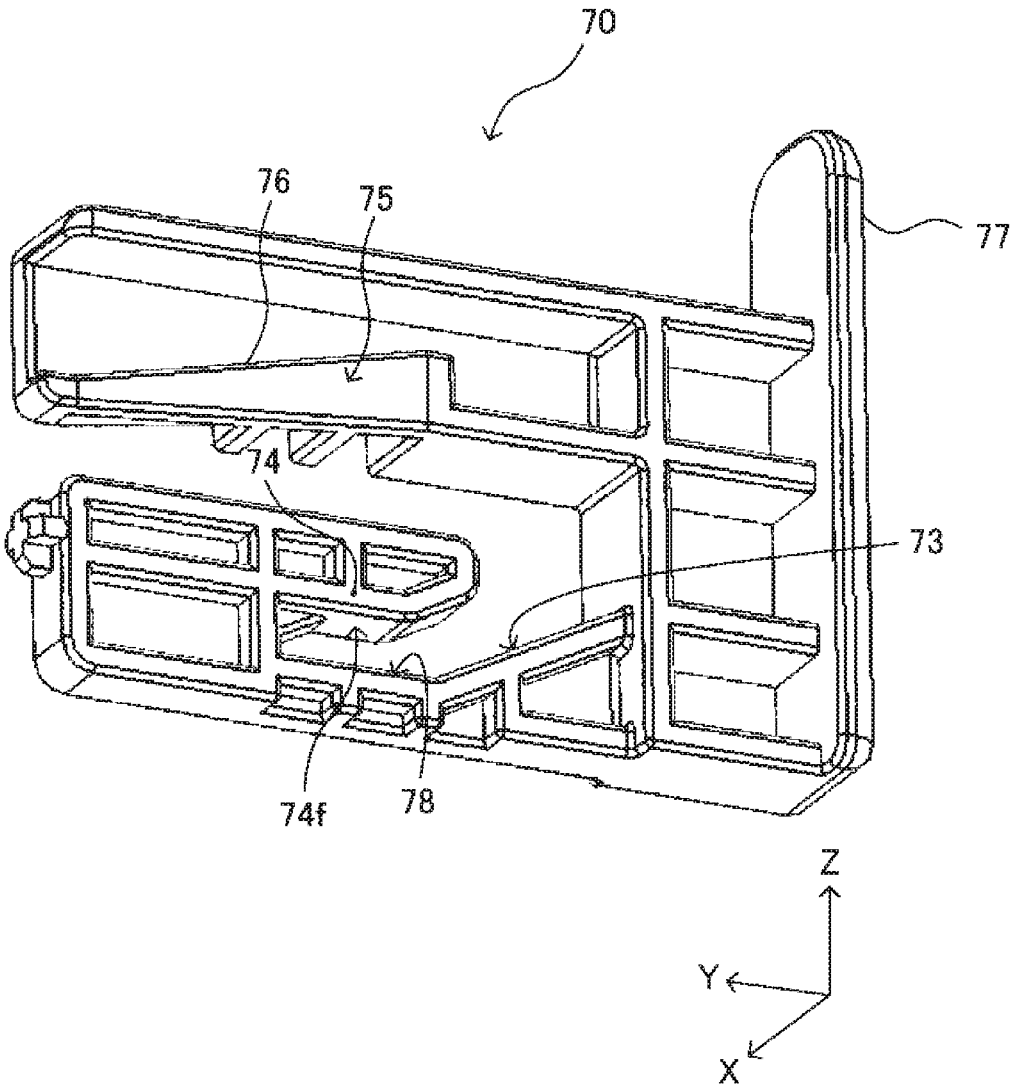
FIG. 15 is a perspective view illustrating the releasing button, viewed from a different angle from the releasing button of FIG. 14.

FIG. 14 is a perspective view illustrating the releasing button 70. FIG. 15 is a perspective view illustrating the releasing button 70, viewed from a different angle from FIG. 14.

The releasing button 70 includes a button control unit 77 that is pressed to release the fixing claw 80. In addition, the releasing button 70 includes a releasing slope 73 and a fixing slide plane 78. The releasing slope 73 is inclined such that the negative Y-axis direction is higher than the other axis directions in FIGS. 14 and 15. The fixing slide plane 78 is parallel to a plane X-Y.

As illustrated in FIGS. 1 and 7 through 13, the fixing claw 80 is held to be slidable in the vertical direction with respect to the fence body frame 61 and is biased to the fence body frame 61 by a fixing claw biasing spring 81 to the fence body frame 61 toward the lower direction (i.e., the negative Z-axis direction).

As illustrated in FIGS. 7 and 10, in the fixed state, a fixing engaging portion 85 that is a lower end of the fixing claw 80 is projected more downwardly than the lower face of the fence body frame 61. As described above, the position of the fixing claw 80 in a state in which the fixing engaging portion 85 is projected more downwardly than the lower face of the fence body frame 61 and is engaged with a rack gear 250, which is described below, is referred to as a "fixing position".

Further, as illustrated in FIGS. 8 and 12, in the released state in which the fixing claw 80 is released, the fixing engaging portion 85 of the fixing claw 80 is located more upwardly than the lower face of the fence body frame 61 and is recessed from the lower face of the fence body frame 61. As described above, the position of the fixing claw 80 in a state in which the fixing engaging portion 85 is located more upwardly than the lower face of the fence body frame 61 and is disengaged from the rack gear 250 is referred to as a "releasing position".

As illustrated in FIGS. 1 and 11, in the fixed state, the fixing slide plane 78 of the releasing button 70 is located at a fixing claw opening portion 84 that is formed in the upper portion of the fixing claw 80. In the fixed state, the fixing claw 80 is biased in the downward direction, and therefore the lower face that forms the fixing claw upper end portion 83 forming an upper end of the fixing claw opening portion 84 (hereinafter, referred to as the "back face of the fixing claw upper end portion 83") contacts the fixing slide plane 78. Accordingly, the fixing claw 80 in the vertical direction is positioned.

As the releasing button 70 in the fixed state is pressed in a direction indicated by arrow A in the drawing and is slid in the positive Y-axis direction, the position at which the back face of the fixing claw upper end portion 83 contacts slides on the fixing slide plane 78 and reaches the releasing slope 73. Further, as the releasing button 70 slides in the positive Y-axis direction, the fixing claw upper end portion 83 moves upwardly along the releasing slope 73. As described above, the fixing claw 80 is lifted against the biasing force of the fixing claw biasing spring 81 and, as illustrated in FIGS. 8 and 12, the state is changed to the released state in which the fixing engaging portion 85 of the fixing claw 80 is recessed upwardly to the lower face of the fence body frame 61.

In the present embodiment, the fixing claw 80 is biased downwardly by the fixing claw biasing spring 81. However, the configuration is not limited thereto. For example, the fixing claw biasing spring 81 may not be provided and the fixing claw 80 may be moved downwardly by the own weight. Even in the configuration in which the fixing claw 80 is moved downwardly by the own weight, a fixing claw contact portion 74 contacts the fixing claw upper end portion 83 in a state in which the fixing claw 80 is located at the fixing position, and therefore the fixed state is maintained. However, backlash or an error in motion occurs in the configuration without the fixing claw biasing spring 81. Therefore, it is desired that the fixing claw biasing spring 81 is provided in order to eliminate backlash.

Figure 16:
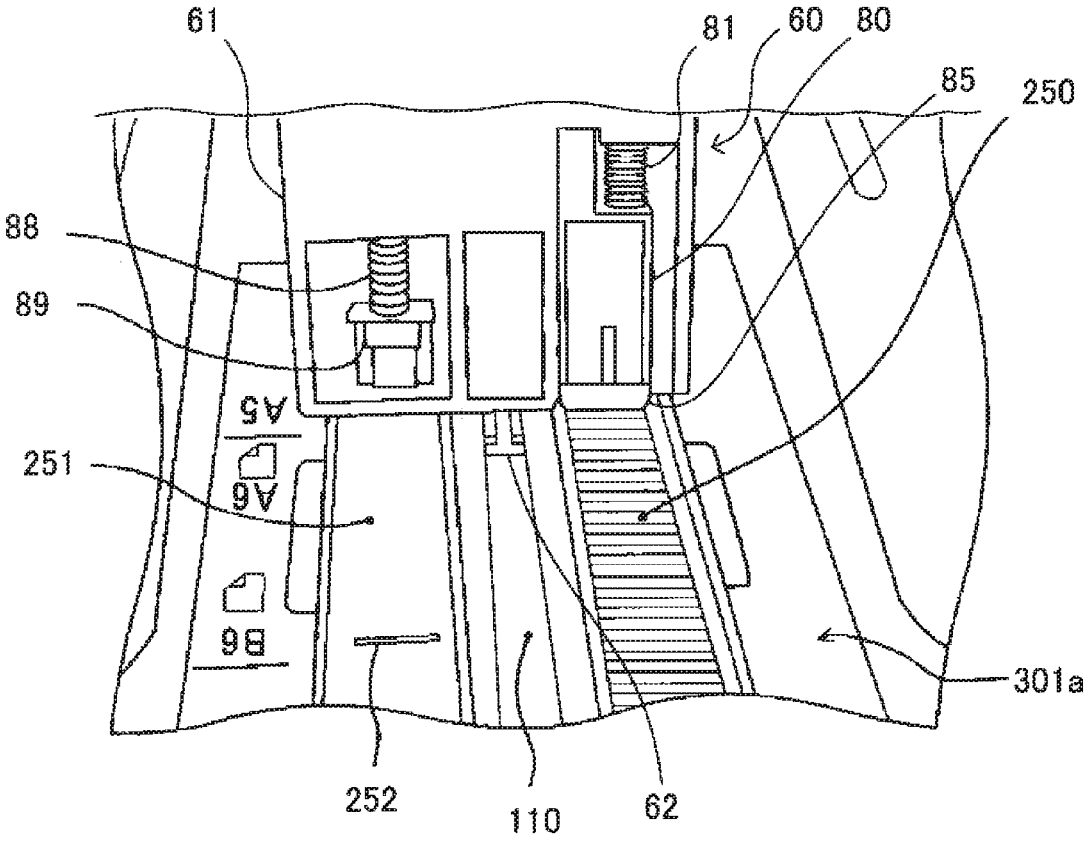
FIG. 16 is a diagram illustrating an engaging portion of the end fence in the fixed state and a tray housing, viewed from an upstream side of a sheet conveying direction.

FIG. 16 is a diagram illustrating an engaging portion of the end fence 60 in the fixed state and the bottom face 301*a*, viewed from the upstream side of the sheet conveying direction.

As illustrated in FIG. 16, the rack gear 250 is fixedly mounted on the bottom face 301*a* of the sheet feed tray 30. The rack gear 250 functions as a loader side engaging portion at which the rack gear 250 is engaged with the fixing engaging portion 85 of the fixing claw 80.

Figure 17:
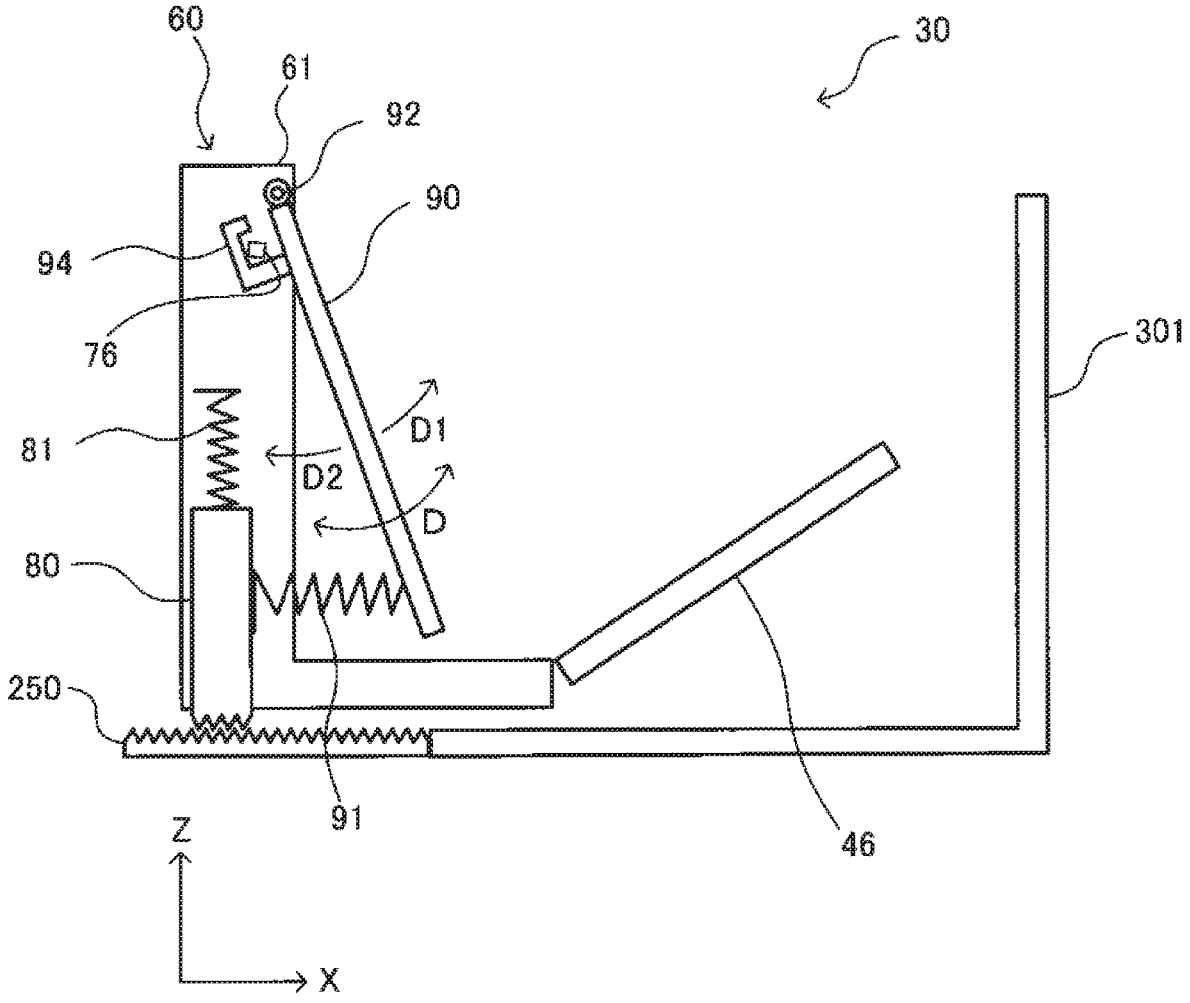
FIG. 17 is a schematic side view illustrating the sheet feed tray without any sheet loaded.
Figure 18:
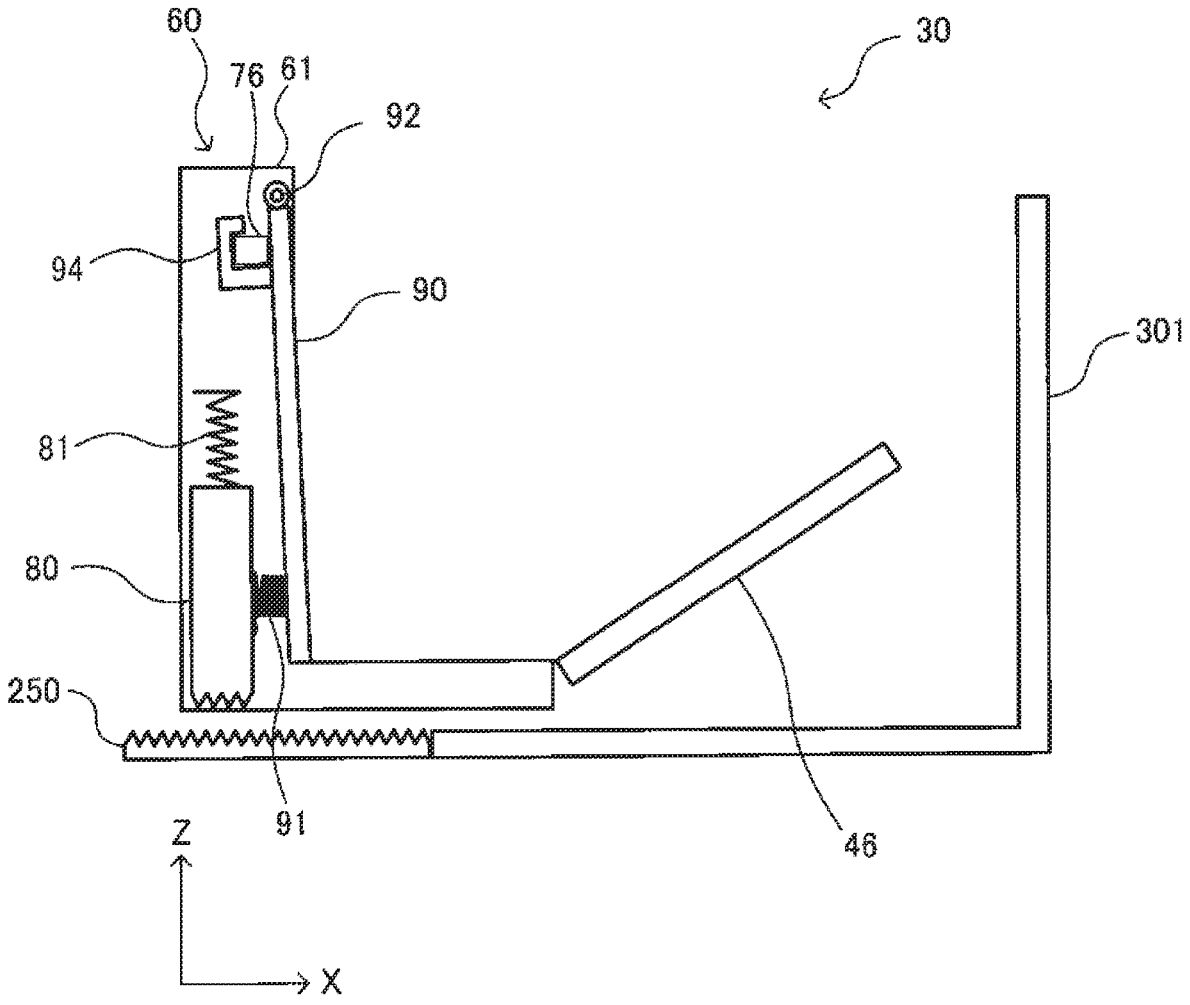
FIG. 18 is a schematic side view illustrating the sheet feed tray when the end fence is in the released state to the tray housing.
Figure 19:
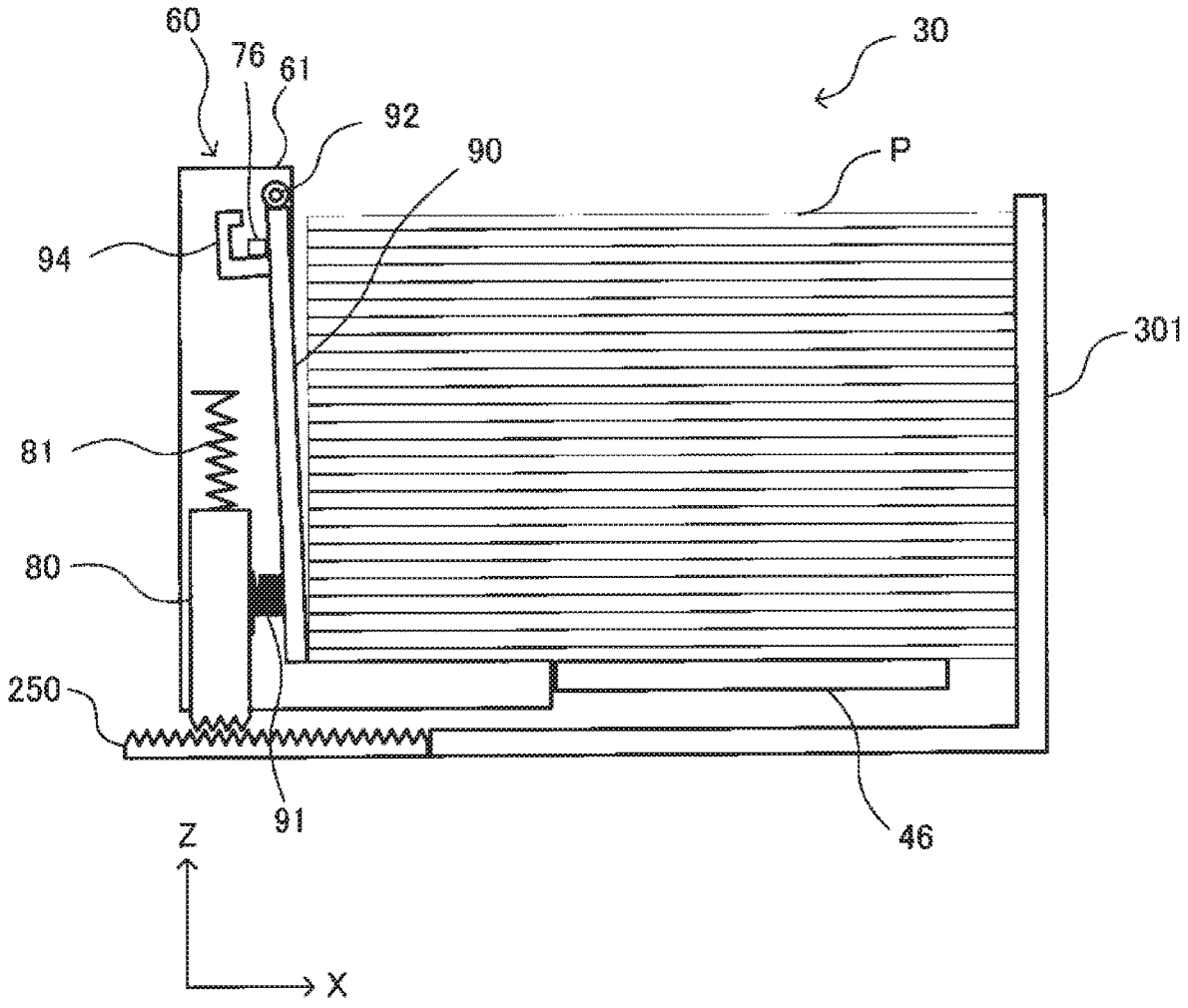
FIG. 19 is a schematic side view illustrating a state in which the position of a trailing end of the sheet is regulated by the end fence.

FIG. 17 is a schematic side view illustrating the sheet feed tray 30 before the sheet P is loaded thereon. The end fence 60 in FIG. 17 is in the fixed state to the tray housing 301. FIG. 18 is a schematic side view illustrating the sheet feed tray 30 when the end fence 60 is in the released state to the tray housing 301. FIG. 19 is a schematic side view illustrating the sheet feed tray 30 in a state in which the position of the trailing end of the sheet P is regulated by the end fence 60.

The tray housing 301 includes the tray front portion 101 and the tray rear portion 102 and functions as a sheet loading portion on which the sheet P is loaded to be conveyed toward the image forming device 400 that is a sheet conveyance target. The end fence 60 is a trailing end fixing device that is movable in a direction along the sheet conveying direction to the tray housing 301 (i.e., in the X-axis direction in the drawing) and that regulates the position of the trailing end of the sheet P in the sheet conveying direction.

The end fence 60 includes the L-shaped fence body frame 61 having the end fence engaging portion 62 at the lower part of the fence body frame 61. The end fence engaging portion 62 at the lower part of the fence body frame 61 is engaged with the rail groove 110 (see FIGS. 5, 6, and 16) mounted on the tray housing 301 and forms a large part of the outer shape of the end fence 60. According to the configuration in which the fence body frame 61 is engaged with the rail groove 110, the fence body frame 61 is movable along the sheet conveying direction relative to the tray housing 301 and is regulated from moving to the vertical direction and the width direction (in a direction perpendicular to the drawing sheet of FIG. 17).

The fixing claw 80 and the fixing claw biasing swing 81 are attached to the fence body frame 61 and moves in a moving direction (i.e., the X-axis direction) together with the fence body frame 61.

The fixing claw 80 is slidable in the vertical direction (i.e., the Z-axis direction in the drawing) to the fence body frame 61, and the relative movement in the other directions is regulated due to the shape of the fence body frame 61. The upper end of the fixing claw biasing spring 81 contacts the fence body frame 61 and the lower end of the fixing claw biasing spring 81 contacts the fixing claw 80. By so doing, the fixing claw biasing spring 81 biases the fixing claw 80 in the downward direction relative to the fence body frame 61. The leading end of the fixing claw 80 (i.e., the fixing engaging portion 85) biased by the fixing claw biasing spring 81 is engaged with the rack gear 250. Therefore, the positional relation of the tray housing 301 to which the rack gear 250 and the fence body frame 61 to which the fixing claw 80 is attached is fixed. Accordingly, the position of the end fence 60 with respect to the tray housing 301 is fixed, and therefore the position of the trailing end contact plate 90 to the bottom face 301*a* is fixed.

When the releasing button 70 is pressed in a direction indicated by arrow A in FIG. 7 to the end fence 60 in the state illustrated in FIG. 17, the releasing button 70 slides in the positive Y-axis direction, and therefore the fixing claw 80 moves to the upward direction against the biasing force of the fixing claw biasing spring 81. According to this movement of the fixing claw 80, the fixing claw 80 is disengaged from the rack gear 250, and the end fence 60 is released from the tray housing 301 to change to the state illustrated in FIG. 18. Therefore, the end fence 60 becomes movable in the left and right directions (i.e., the X-axis direction) in FIG. 18.

When moving the end fence 60, the apparatus body side handle 63 of the fence body frame 61 illustrated in FIG. 7 and the releasing button 70 are pinched (for example, by the fingers of a user), so that the releasing button 70 slides in the positive Y-axis direction to the fence body frame 61. As a result, the fixing claw 80 slides in the upward direction to be disengaged from the rack gear 250, and thereby releasing the end fence 60. With the apparatus body side handle 63 of the fence body frame 61 and the releasing button 70 being pinched by the fingers of a user as described above, the end fence 60 is slid to a predetermined position that corresponds to the size of the sheet P to be set, and then the fingers are released from the apparatus body side handle 63 and the releasing button 70. Accordingly, the fixing claw 80 moves in the downward direction due to the biasing force of the fixing claw biasing spring 81, and the fixing claw 80 is engaged with the rack gear 250 to change to the state illustrated in FIG. 17. Consequently, the end fence 60 is located at the predetermined position.

The interval of the position at which the end fence 60 is fixed is determined based on the pitch of a gear of the rack gear 250. By reducing the pitch interval, the end fence 60 is moved by a small pitch (e.g., 1 mm intervals). By moving the end fence 60 by a small pitch, regardless of the standard size sheet P such as an A4 size sheet and an A5 size sheet, the end fence 60 is fixed at a position that corresponds to a non-standard size sheet P.

As illustrated in FIGS. 1, 9, 11, 13, and 17 through 19, the end fence 60 includes the trailing end contact plate 90 and the contact plate biasing spring 91. The trailing end contact plate 90 presses the sheet P loaded on the tray housing 301 in the sheet conveying direction. The contact plate biasing spring 91 biases the trailing end contact plate 90. The trailing end contact plate 90 is assembled to be rotatable about a contact plate rotary shaft 92 disposed at the upper end of the trailing end contact plate 90, in a direction indicated by arrow D in FIG. 17 to the fence body frame 61. In other words, the fence body frame 61 rotatably supports the trailing end contact plate 90. The upstream side end of the contact plate biasing spring 91 in the sheet conveying direction (i.e., the left side in FIG. 17) contacts the fence body frame 61 and the downstream side end of the contact plate biasing spring 91 in the sheet conveying direction (i.e., the right side in FIG. 17) contacts the trailing end contact plate 90. Accordingly, the trailing end contact plate 90 is biased such that the lower end of the trailing end contact plate 90 moves toward the downstream side of the sheet conveying direction (i.e., the right side in FIG. 17) to the fence body frame 61, and the trailing end contact plate 90 swings or rotates in a direction indicated by arrow D1 in FIG. 17.

When the sheet bundle of sheets P is loaded on the sheet feed tray 30 in FIG. 17, the bottom plate 46 is pressed by the sheet bundle of sheets P and the downstream side portion of the bottom plate 46 in the sheet conveying direction is lowered. Consequently, as illustrated in FIG. 19, the upper face of the bottom plate 46 becomes substantially horizontal (i.e., the plane X-Y). Further, the trailing end contact plate 90 is also pressed by the sheet bundle of sheets P, and the lower end of the trailing end contact plate 90 is rotated in a direction indicated by arrow D2 in FIG. 17 so as to move to the upstream side of the sheet conveying direction. Consequently, the contact plate biasing spring 91 is compressed, as illustrated in FIG. 19. At this time, the biasing force of the contact plate biasing spring 91 is applied to the trailing end contact plate 90 that is in contact with the trailing end of the sheet P, so that the trailing end contact plate 90 presses the sheet bundle of sheets P loaded on the sheet feed tray 30 toward the downstream side of the sheet conveying direction.

As the (set) number of sheets P of the sheet bundle decreases according to the feeding of the sheets P, the force of the sheet P to press the trailing end contact plate 90 decreases. Therefore, the lower end of the trailing end contact plate 90 moves to the downstream side of the sheet conveying direction to a position at which the biasing force of the contact plate biasing spring 91 to bias the trailing end contact plate 90 and the pressing force of the sheet P to press the trailing end contact plate 90 are balanced. Then, the position of the trailing end of the sheet P that is regulated by the trailing end contact plate 90 moves to the downstream side of the sheet conveying direction.

As described above, the sheet P is lifted in the upward direction by the bottom plate 46 and is fed by the sheet feed roller 47. At this time, the positional relation of the position of the leading end of the sheet P and the separating portion is significantly determined and the position of the leading end of the sheet P may need to be set and held at the identical position regardless of the set number of sheets P.

In the sheet feed tray 30 according to the present embodiment, as the bottom plate 46 is rotated about the bottom plate rotary shaft 51 to lift the downstream side end of the bottom plate 46 in the sheet conveying direction, the downstream side end of the sheet P in the sheet conveying direction (i.e., the leading end side of the sheet P) is lifted in the upward direction. In the configuration in which the bottom plate 46 is rotated as described above, when the trailing end of the sheet P is located at a constant position regardless of the set number of sheets P, the position of the leading end of the sheet P varies depending on the set number of sheets P. If the position of the leading end of the sheet P varies and comes out from a target range, it is likely that defects such as paper jam and curling at the leading end of the sheet P occur.

By contrast, in the sheet feed tray 30 according to the present embodiment, the lower end of the trailing end contact plate 90 of the end fence 60 moves in the sheet conveying direction according to the set number of sheets P, as described above. Therefore, the trailing end contact plate 90 presses the sheet P when the set number of sheets Pis relatively small, so that the fixing position of the trailing end of the sheet P is located closer to the downstream side of the sheet conveying direction when compared with the case in which the set number of sheets P is relatively large. Accordingly, the position of the leading end of the sheet P is assigned as the predetermined position at which the sheet P is appropriately fed by the sheet feed roller 47.

Therefore, the position of the leading end of the sheet P to the separating portion becomes stable, and therefore the sheet feeding device 300 can feed the sheet Pin a stable manner.

Further, in the image forming apparatus 100 including the sheet feeding device 300 that feeds the sheet P in a stable manner, the timing to feed the sheet P to the secondary transfer nip region becomes stable, and therefore defects such as positional deviation of an image to be formed is prevented. Accordingly, the image is formed in the stable manner.

As illustrated in FIG. 16, the end fence 60 includes a resistance projection member 89 and a projection member pressing spring 88. The resistance projection member 89 functions as a released movement fixing device to regulate movement of the end fence 60 when the fixing claw 80 is released. The projection member pressing spring 88 biases the resistance projection member 89 in the downward direction. The resistance projection member 89 is movable in the vertical direction that is a direction to contact and separate a plate portion 251 (i.e., a friction board) that is mounted on the bottom face 301*a* of the tray housing 301 to the end fence 60. The resistance projection member 89 is pressed in the downward direction by the projection member pressing spring 88. According to this pressing of the resistance projection member 89, the resistance projection member 89 contacts the plate portion 251, thereby generating a resistant force to the relative movement of the end fence 60 and the tray housing 301 according to a friction load generated between the resistance projection member 89 that is biased by the projection member pressing spring 88 and the plate portion 251.

Accordingly, when the releasing button 70 is pressed to change to the released state, the end fence 60 is prevented from sweeping or powerfully moving to the tray housing 301.

As illustrated in FIGS. 1, 7 through 13, and 16, the fixing claw 80 and the resistance projection member 89 are aligned along the width direction of the end fence 60 (i.e., the left and right direction in FIG. 16).

Further, as illustrated in FIG. 16, the plate portion 251 of the bottom face 301*a* includes a V-shaped groove 252 at a position that corresponds to the sheet P of a standard size (i.e., the position corresponding to "B6" in FIG. 16).

By providing the V-shaped groove 252 at the position corresponding to the standard size sheet P, when the end fence 60 that moves on the bottom face 301*a* reaches the position corresponding to the standard size of the sheet P, the resistance projection member 89 falls in the V-shaped groove 252 and stops with a click sound. Due to the sound generated when the resistance projection member 89 falls in the V-shaped groove 252, it is easily recognized that the end fence 60 is located at the position corresponding to the sheet P of the standard size, and therefore the operability to change the position of the end fence 60 is enhanced.

Next, a description is given of the end fence 60 according to the present embodiment.

As illustrated in FIG. 1, the releasing button 70 that is provided to the end fence 60 includes a fixing claw contact portion 74 to which the fixing claw upper end portion 83 of the fixing claw 80 in the fixed state is attached. As described above, the releasing button 70 is regulated from moving to the fence body frame 61 in a direction other than the Y-axis direction, and therefore the position of the releasing button 70 in the vertical direction is regulated. When the fixing claw upper end portion 83 of the fixing claw 80 contacts a fixing claw contacting face 74*f* that is the lower face of the fixing claw contact portion 74 of the releasing button 70, the fixing claw 80 is restrained from moving to the upward direction to the fence body frame 61. According to this configuration, the fixing claw 80 is prevented from moving from the fixing position to the releasing position. As described above, the releasing button 70 has a function as a contact body to contact the fixing claw 80 and regulate the fixing claw 80 that functions as a fixing body from moving from the fixing position to the releasing position.

The end fence 60 according to the present embodiment biases the fixing claw 80 in the direction in which the fixing engaging portion 85 and the rack gear 250 are engaged with each other by the fixing claw biasing spring 81. Even in the configuration without a contact body that contacts the fixing claw 80, the fixing claw 80 may be restrained from moving from the fixing position to the releasing position by the biasing force of the fixing claw biasing spring 81, However, in a case in which the sheet feed tray 30 is attached to the apparatus body of the image forming apparatus 100 powerfully, a large amount of impact is applied to the sheet feed tray 30, and therefore a force in the upward direction is applied to the fixing claw 80. When the force in the upward direction is greater than the biasing force of the fixing claw biasing spring 81, the fixing claw 80 moves in the upward direction. Consequently, the fixing engaging portion 85 and the rack gear 250 are disengaged from each other to change to the released state. When any force is applied in the released state, the end fence 60 moves on the bottom face 301*a*, and therefore the trailing end of the sheet P cannot be regulated at the desired fixing position.

Further, similar to the end fence 60 according to the present embodiment, in the configuration in which the trailing end contact plate 90 presses the trailing end of the sheet P, when the end fence 60 is released unintentionally while the sheet bundle of sheets P are loaded on the sheet feed tray 30 as illustrated in FIG. 19, the end fence 60 may easily move on the bottom face 301*a*. This defect is caused for the following reasons.

Specifically, in a state in which the set number of sheets P is relatively small or in which no sheet P is set, the lower end of the trailing end contact plate 90 has completely moved to the downstream side in the sheet conveying direction, as illustrated in FIG. 17, and therefore the length of the contact plate biasing spring 91 is substantially a natural length. In this state, the contact plate biasing spring 91 does not apply a force by which the contact plate biasing spring 91 presses the fence body frame 61 to the upstream side of the sheet conveying direction. Therefore, even when any force is applied to the fixing claw 80 to change to the released state, it is unlikely that the end fence 60 moves.

By contrast, as illustrated in FIG. 19, when the set number of sheets is relatively, large, the lower end of the trailing end contact plate 90 is pressed by the sheet bundle of sheets P to move to the upstream side of the sheet conveying direction, and therefore the contact plate biasing spring 91 is compressed. In this state, a biasing force by which the downstream end of the sheet conveying direction of the contact plate biasing spring 91 contacts and presses the trailing end contact plate 90 to which the downstream end of the sheet conveying direction of the contact plate biasing spring 91 is applied. Then, the trailing end contact plate 90 contacts the trailing end of the sheet bundle of sheets P, and the leading end of the sheet bundle of sheets P contacts a wall of the tray housing 301 on the downstream side of the sheet conveying direction. Therefore, the biasing force is applied to bias the fence body frame 61 to which the end of the compressed contact plate biasing spring 91 on the upstream side of the sheet conveying direction contacts to the upstream side of the sheet conveying direction.

Figure 20:
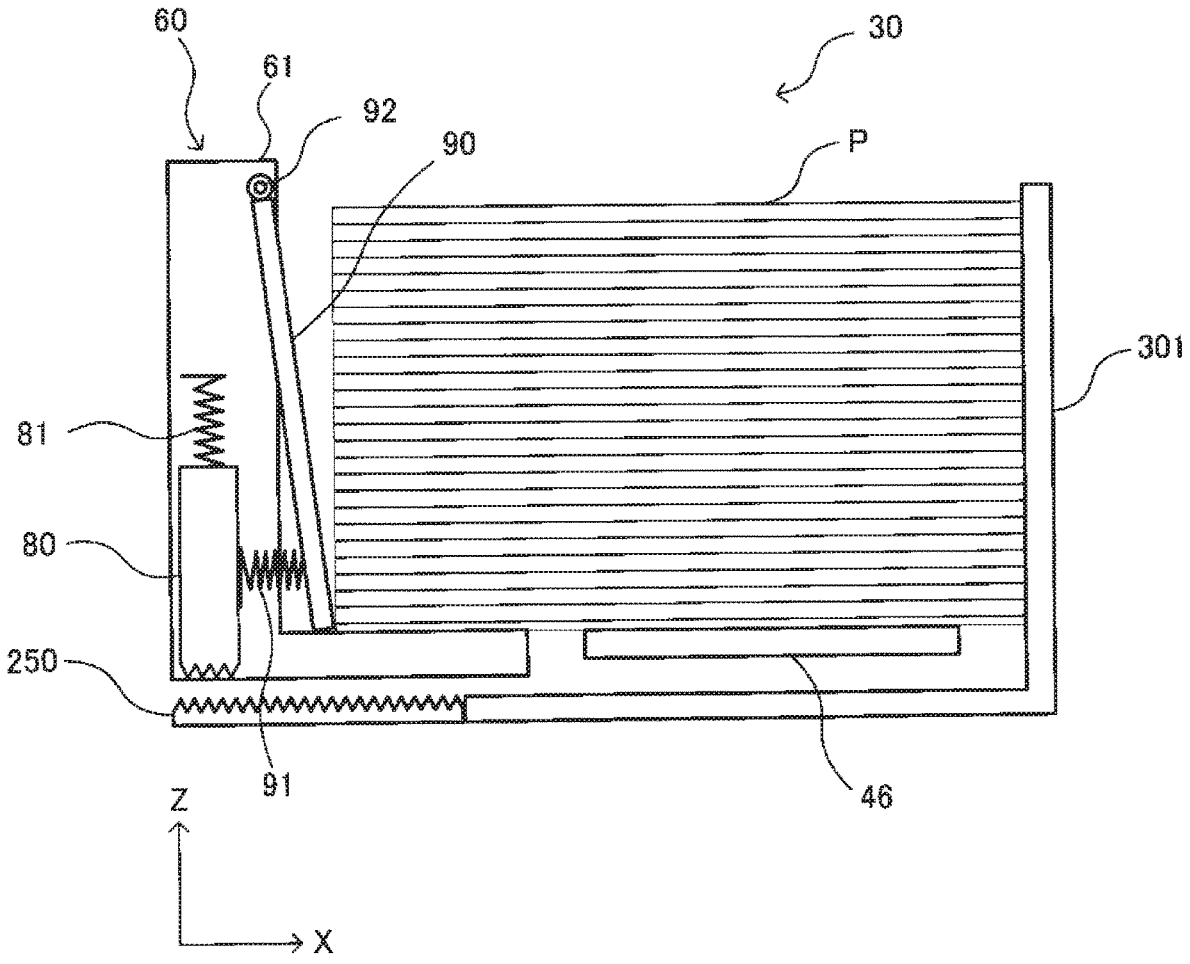
FIG. 20 is a schematic side view illustrating the sheet feed tray in a state in which the end fence has been moved to the upstream side of the sheet conveying direction due to a biasing force applied by a contact plate biasing spring.

In a state in which the biasing force is being applied to the fence body frame 61, a relatively large impact is applied to the sheet feed tray 30, and a force is likely to be applied to cause the fixing claw 80 to move in the upward direction. In such a case, the end fence 60 is released while the biasing force to bias the fence body frame 61 to the upstream side of the sheet conveying direction is applied. Therefore, as illustrated in FIG. 20, the end fence 60 is moved to the upstream side of the sheet conveying direction due to the biasing force of the contact plate biasing spring 91.

When the end fence 60 is moved to the upstream side of the sheet conveying direction, a force to press the sheet P in the sheet conveying direction at the trailing end contact plate 90 is reduced or the position of the trailing end contact plate 90 is moved to the upstream side of the sheet conveying direction. Consequently, the leading end of the sheet P is not pushed to the predetermined position, and a gap or space is generated between the leading end of the sheet P and the wall of the tray housing 301 on the downstream side of the sheet conveying direction, resulting in performance of an unstable sheet feeding operation. Therefore, defects such as curling at the leading end of the sheet P and paper jam occur easily.

In order to address the above-described defects, in the sheet feed tray 30 according to the present embodiment, the releasing button 70 includes the fixing claw contact portion 74 to function as a contact body. As the releasing button 70 contacts the fixing claw 80, the fixing claw 80 is restrained from moving from the fixing position to the releasing position at an unintentional timing, and therefore the end fence 60 is prevented from moving. Accordingly, the end fence 60 is prevented from moving to the direction opposite the sheet conveying direction at an unintentional timing due to application of a relatively large impact to the sheet feed tray 30.

The releasing button 70 of the end fence 60 according to the present embodiment includes the releasing slope 73 that causes the fixing claw 80 to move from the fixing position to the releasing position and the fixing claw contact portion 74 to contact the fixing claw upper end portion 83 of the fixing claw 80. Then, the releasing slope 73 causes the fixing claw 80 to move from the fixing position to the releasing position along with movement of the fixing claw contact portion 74 from a contact position at which the fixing claw contact portion 74 contacts the fixing claw 80 to a non-contact position at which the fixing claw contact portion 74 does not contact the fixing claw 80. As described above, the releasing button 70 has a function as a contact body and a function as a releasing body.

More specifically, as the releasing button 70 is pressed to the end fence 60 in the fixed state, the releasing button 70 slides in the positive Y-axis direction to a position at which the fixing claw contacting face **74*f* of the fixing claw contact portion 74 does not contact the fixing claw upper end portion 83. Accordingly, the fixing claw 80 comes to be movable in the upward direction but is biased by the fixing claw biasing spring 81. Therefore, the back face of the fixing claw upper end portion 83 contacts the fixing slide plane 78. Further, as the releasing button 70 is pressed to slide in the positive Y-axis direction, the contact position to which the back face of the fixing claw upper end portion 83 contacts is moved from the fixing slide plane 78 to the releasing slope 73. Accordingly, the fixing claw upper end portion 83 is pressed upwardly along the releasing slope 73, and the fixing claw 80 is moved in the upward direction against the biasing force of the fixing claw biasing spring 81, and the fixing claw 80** is moved from the fixing position to the releasing position.

Further, when a user releases the finger from the releasing button 70 in the pressed state, the releasing button 70 slides in the negative Y-axis direction as indicated by arrow A' in the drawing, due to the biasing force of the releasing button biasing spring 71. At this time, the fixing claw upper end portion 83, the back face of which contacts the releasing slope 73 due to the biasing force of the fixing claw biasing spring 81, is moved downwardly along the releasing slope 73. Consequently, the fixing claw 80 is lowered to the fixing position. As the releasing button 70 further slides in the negative Y-axis direction, the fixing claw upper end portion 83 contacts the fixing slide plane 78, and the fixing claw contacting face **74*f* of the fixing claw contact portion 74 is moved to the position to contact the fixing claw upper end portion 83. Accordingly, the fixing claw contact portion 74 of the releasing button 70 that functions as a contact body contacts the fixing claw upper end portion 83, so that the movement of the fixing claw 80** to the releasing position is regulated, which is a contact state.

As described above, the end fence 60 performs, along with one operation to press the releasing button 70, an operation to cancel the contact state and another operation to move the fixing claw 80 from the fixing position to the releasing position. Further, along with one operation to release the releasing button 70, the end fence 60 performs an operation to move the fixing claw 80 from the releasing position to the fixing position and another operation to change the state to the contact state. Accordingly, the fixing claw 80 is prevented from moving to the releasing position at an unintentional timing, and therefore the operability is enhanced.

The operation to change the state from the contact state and the operation to move the fixing claw 80 from the fixing position to the releasing position may be performed separately. Further, the operation to move the fixing claw 80 from the releasing position to the fixing position and the operation to change the state to the contact state may be performed separately. However, by performing two operations along with one operation, the operability can be enhanced. Further, by performing the operation to change the state to the contact state along with the operation to move the fixing claw 80 from the releasing position to the fixing position, the state is changed to the contact state without fail after the end fence 60 is moved.

In the end fence 60, when the fixing claw 80 is at the fixing position, the movement of the fixing claw 80 to the releasing position is regulated by the fixing claw contact portion 74 of the releasing button 70 that functions as a contact body. Then, immediately before the fixing claw 80 is moved to the releasing position by the releasing slope 73 of the releasing button 70 that includes a function as a releasing body, the fixing claw contact portion 74 of the releasing button 70 is moved to a non-contact position at which the fixing claw contact portion 74 of the releasing button 70 does not contact the fixing claw 80. Accordingly, it is prevented that the fixing claw 80 moves to the releasing position at the unintentional timing immediately before the fixing claw 80 is moved to the releasing position by the releasing body.

When the releasing button 70 is moved to the contact position, the fixing claw upper end portion 83 of the fixing claw 80 and the fixing claw contact portion 74 of the releasing button 70 contact to each other. By so doing, the releasing button 70 prevents the fixing claw 80 from moving from the fixing position to the releasing position. According to this operation, it is prevented that the fixing claw 80 is lifted upwardly.

In the present embodiment, when the releasing button 70 is located at the contact position, the fixing claw upper end portion 83 and the fixing claw contact portion 74 continuously abut (contact) to each other. However, if the position of the fixing claw 80 can be maintained in the fixing position, while the fixing claw upper end portion 83 and the fixing claw contact portion 74 are disposed apart from each other with a predetermined gap (backlash), the fixing claw upper end portion 83 and the fixing claw contact portion 74 may contact to each other for the first time when the fixing claw upper end portion 83 is moved in the vertical direction. In such a configuration, when a user operates (moves) the sheet feed tray 30 in a state in which the releasing button 70 is moved to the contact position, it is likely that the fixing claw 80 moves in the vertical direction by the predetermined gap (backlash) after receiving an impact by movement of the sheet feed tray 30. However, the fixing claw 80 moves in the vertical direction within a range in which the fixing claw 80 is maintained at the fixing position, in other words, within a range in which the fixing engaging portion 85 does not climb over the rack gear 250. Therefore, the fixing of the end fence 60 by the fixing claw 80 is not released by mistake. Therefore, it is prevented that the position of the end fence 60 on the bottom face 301*a* changes at an unintentional timing.

As illustrated in FIG. 18, when the end fence 60 according to the present embodiment is in a state in which the lower end of the trailing end contact plate 90 is regulated from moving to the downstream side of the sheet conveying direction (i.e., the right side of FIG. 18) from the predetermined position by the biasing force of the contact plate biasing spring 91. This state is a force suspending state in which the biasing force of the contact plate biasing spring 91 is not applied to the trailing end of the sheet P via the trailing end contact plate 90.

By contrast, as illustrated in FIGS. 17 and 19, in the fixed state, the lower end of the trailing end contact plate 90 is movable to the downstream side of the sheet conveying direction (i.e., the right side of FIG. 17) from the predetermined position by the biasing force of the contact plate biasing spring 91. This state is a force applying state in which the biasing force of the contact plate biasing spring 91 is applied to the trailing end of the sheet P via the trailing end contact plate 90.

The predetermined position is a position at which the right face of a contact plate hooking face 94 (i.e., an inner face having a hook shape) and the left face of a thickness varying portion 76 (i.e., a surface of a move and stop switching slope 75) contact to each other and the trailing end contact plate 90 is not rotated any further to the right direction, as illustrated in FIG. 18. In the state of FIG. 17 (a first state), the trailing end contact plate 90 is rotatable to move to the right direction from the predetermined position. In the state of FIG. 18 (a second state), the trailing end contact plate 90 is regulated from rotating and moving to the right direction from the predetermined position.

The end fence 60 includes the move and stop switching slope 75 on the releasing button 70. The move and stop switching slope 75 functions as a switching body to switch a state in which movement of the trailing end contact plate 90 is regulated by the biasing force and a state in which the trailing end contact plate 90 is movable due to the biasing force.

As illustrated in FIG. 14, the releasing button 70 includes the thickness varying portion 76 at which the thickness in the X-axis direction continuously changes from a thickness "d1" to a thickness "d2" depending on the position of the releasing button 70 in the Y-axis direction (d1<d2). The move and stop switching slope 75 that is inclined to project toward the negative X-axis direction is formed as the face of the thickness varying portion 76 on the negative X-axis side is located to the negative Y-axis direction.

By contrast, as illustrated in FIGS. 1, 7 through 12, and 7 through 19, the trailing end contact plate 90 includes the contact plate hooking face 94 on an opposite side face to the side to contact the trailing end of the sheet P. The contact plate hooking face 94 is hooked to the thickness varying portion 76. The contact plate hooking face 94 contacts the move and stop switching slope 75 on the hook-shaped inner face.

In the fixed state, a relatively thin portion of the thickness varying portion 76, that is, a portion having a smaller amount of projection of the move and stop switching slope 75 to the negative X-axis direction is opposed to the contact plate hooking face 94. In the above-described fixed state, the trailing end contact plate 90 is rotatable in the direction indicated by arrow D1 in FIG. 17 to the position to which the inner face of the contact plate hooking face 94 contacts the move and stop switching slope 75, due to the biasing force of the contact plate biasing spring 91.

In this fixed state, as the sheet bundle of sheets P is loaded on the sheet feed tray 30 and the lower end of the trailing end contact plate 90 pressed by the sheet bundle is moved to the upstream side of the sheet conveying direction, the contact plate hooking face 94 is moved to the upstream side of the sheet conveying direction (i.e., the negative X-axis direction). According to this movement of the contact plate hooking face 94, the contact plate hooking face 94 separates from the move and stop switching slope 75, as illustrated in FIG. 19.

When the releasing button 70 in the fixed state is pressed and slid to the positive Y-axis direction, the portion facing the contact plate hooking face 94 on the thickness varying portion 76 is slid in the X-axis direction to a portion having a greater amount of thickness. According to this slide of the portion facing the contact plate hooking face 94, the contact plate hooking face 94 is moved in the negative X-axis direction along the move and stop switching slope 75, and the trailing end contact plate 90 is rotated in a direction indicated by arrow D2 in FIG. 17 against the biasing force of the contact plate biasing spring 91.

When the releasing button 70 slides in the positive Y-axis direction until the state is changed to the released state, the thickness of the thickness varying portion 76 at a portion that is opposed to the contact plate hooking face 94 corresponds to a thickness "d2". At this time, the biasing force of the contact plate biasing spring 91 is applied to the trailing end contact plate 90. However, since the contact plate hooking face 94 and the move and stop switching slope 75 contact to each other, the movement of the trailing end contact plate 90 due to the biasing force of the contact plate biasing spring 91 is regulated. Then, as illustrated in FIG. 18, the trailing end contact plate 90 is not projected to the fence body frame 61. Therefore, even when the sheet bundle of sheets P is loaded on the sheet feed tray 30, the trailing end contact plate 90 does not press the trailing end of the sheet bundle of sheets P.

As a user releases the finger from the releasing button 70 in the released state, the releasing button 70 slides in the negative Y-axis direction due to the biasing force of the releasing button biasing spring 71. Consequently, the portion of the thickness varying portion 76 facing the contact plate hooking face 94 slides in the X-axis direction toward the thin portion. Accordingly, the contact plate biasing spring 91 is movable in the positive X-axis direction along the move and stop switching slope 75, and the trailing end contact plate 90 is rotatable in a direction indicated by arrow D1 in FIG. 17 due to the biasing force of the contact plate biasing swing 91.

As described above, with the configuration of the end fence 60 according to the present embodiment, the releasing button 70 is slid in the Y-axis direction. Consequently, a contact position of the move and stop switching slope 75 to which the contact plate hooking face 94 contacts changes. Due to the change of the contact position, the state in which the trailing end contact plate 90 is movable due to the biasing force and the state in which the trailing end contact plate 90 is regulated from moving are switched. Accordingly, the move and stop switching slope 75 has a function as a switching body.

As described above, when the releasing button 70 of the end fence 60 in the fixed state is pressed in the negative X-axis direction to change the state to the released state, the trailing end contact plate 90 is lowered to the upstream side of the sheet conveying direction (i.e., the negative X-axis direction). Accordingly, when the end fence 60 in the released state contacts the trailing end of the sheet bundle of sheets P loaded on the sheet feed tray 30, the trailing end contact plate 90 is changed to a closed state. In this state, the visibility of the set position of the end fence 60 with respect to the trailing end of the sheet P is enhanced and, as illustrated in FIG. 19, the sheet bundle of sheets P and the end fence 60 are set to the correct positional relation easily. Therefore, erroneous setting of the sheet bundle of sheets P is prevented.

By contrast, in a case in a state in which no mechanism to lower the trailing end contact plate 90 is not provided, it is likely that a state in which the trailing end contact plate 90 contacts the sheet P while the trailing end contact plate 90 is open due to the biasing force of the contact plate biasing spring 91, as illustrated in FIG. 20, is misunderstood as the correct positional relation. As illustrated in FIG. 20, the positional relation is not correct, the position of the sheet P in the sheet feed tray 30 is not fixed, which is likely to cause no sheet feeding. The end fence 60 according to the present embodiment prevents the sheet P from being set in the sheet feed tray 30 at an incorrect positional relation. Therefore, the position of the sheet P in the sheet feed tray 30 is fixed, and no sheet feeding is prevented.

In addition, the move and stop switching slope 75 switches the state of the trailing end contact plate 90 between a state in which the trailing end contact plate 90 is movable along with movement of the fixing claw 80 along the releasing slope 73 and a state in which the trailing end contact plate 90 is regulated from moving. By pushing the releasing button 70 to the end fence 60 in the fixed state, which is a state in which the trailing end contact plate 90 is movable, the releasing button 70 slides in the positive Y-axis direction, and the fixing claw 80 is moved from the fixing position to the releasing position along the releasing slope 73. At this time, the contact plate hooking face 94 is moved in the negative X-axis direction along the move and stop switching slope 75, and the trailing end contact plate 90 is rotated in the direction indicated by arrow D2 in FIG. 17 against the biasing force of the contact plate biasing spring 91. Consequently, the trailing end contact plate 90 is regulated from moving.

In addition, when the user releases the finger from the releasing button 70 in the pressed state while the end fence 60 is in the released state, the releasing button 70 slides in the negative Y-axis direction due to the biasing force of the releasing button biasing spring 71.

At this time, the fixing claw 80 is lowered along the releasing slope 73 to the fixing position. Further, when the releasing button 70 slides in the negative Y-axis direction, the releasing button 70 is slid in a state in which the fixing claw 80 contacts the fixing slide plane 78, and the state is changed to the fixed state.

Along with this operation to change the state to the fixed state, the portion of the move and stop switching slope 75 at which the move and stop switching slope 75 is opposed to the contact plate hooking face 94 slides to the negative X-axis direction toward the portion having a smaller amount of projection. Then, the contact plate hooking face 94 is movable in the positive X-axis direction to the position to contact the move and stop switching slope 75. That is, the trailing end contact plate 90 is rotatable in the direction indicated by arrow D1 in FIG. 17 due to the biasing force of the contact plate biasing spring 91.

As described above, the end fence 60 performs an operation to move the fixing claw 80 from the fixing position to the releasing position and another operation to switch from a movable state in which the trailing end contact plate 90 is movable to a regulated state in which the trailing end contact plate 90 is regulated from moving, along with the operation to press the releasing button 70. Further, the end fence 60 also performs an operation to move the fixing claw 80 from the releasing position to the fixing position and another operation to switch from the regulated state in which the trailing end contact plate 90 is regulated from moving to the movable state in which the trailing end contact plate 90 is movable, along with the operation to release the releasing button 70. Therefore, the operability is enhanced according to the configuration in which the trailing end contact plate 90 is biased by the contact plate biasing spring 91 and the trailing end contact plate 90 is regulated from moving so as not to be projected to the fence body frame 61.

It is to be noted that the operation to switch the movable state in which the trailing end contact plate 90 is movable and the regulated state in which the trailing end contact plate 90 is regulated from moving and the operation to move the fixing claw 80 between the fixing position and the releasing position may be performed by different operations. However, the operability is enhanced by performing two different operations along with one operation.

The end fence 60 according to the present embodiment has the configuration in which, when a user releases the finger from the releasing button 70 in the released state to cancel the pressure, the trailing end contact plate 90 has completely projected to the fence body frame 61 after the fixing claw 80 is moved from the releasing position to the fixing position.

This state is made due to the following configuration.

Specifically, while the releasing button 70 is sliding from the released state to the fixed state, the portion of the fixing claw upper end portion 83 to which the back face of the fixing claw upper end portion 83 contacts slides on the releasing slope 73, and then slides on the fixing slide plane 78. At this time, when the portion to which the back face of the fixing claw upper end portion 83 contacts reaches the lower end of the releasing slope 73, the fixing claw 80 is located at the fixing position. Thereafter, while the portion to which the back face of the fixing claw upper end portion 83 contacts is sliding on the fixing slide plane 78, the fixing claw 80 remains at the fixing position.

By contrast, the contact plate hooking face 94 remains in contact with the move and stop switching slope 75 even while the portion to which the back face of the fixing claw upper end portion 83 contacts is sliding on the fixing slide plane 78. Therefore, even after the fixing claw 80 has reached the fixing position, the amount of projection of the move and stop switching slope 75 in the negative X-axis direction at a position to which the contact plate hooking face 94 contacts continuously decreases and the amount of projection of the trailing end contact plate 90 to the fence body frame 61 continuously increases. Then, when the releasing button 70 slides to the fixed state, the trailing end contact plate 90 has fully been projected to the fence body frame 61.

As described above, by finishing the movement of the fixing claw 80 to the fixing position before the trailing end contact plate 90 has completely projected to the fence body frame 61, the positional deviation of the end fence 60 to the tray housing 301 due to a projecting force of the trailing end contact plate 90 is restrained.

When the releasing button 70 slides from the released state to the fixed state and the fixing claw 80 is moved from the releasing position to the fixing position, it is preferable that the regulated state in which the trailing end contact plate 90 is regulated from moving is started to change to the movable state in which the trailing end contact plate 90 is movable, after the fixing claw 80 has started moving. Similarly, when the releasing button 70 slides from the fixed state to the released state and the fixing claw 80 is moved from the fixing position to the releasing position, it is preferable that the movable state in which the trailing end contact plate 90 is movable is started to change to the regulated state in which the trailing end contact plate 90 is regulated from moving, before the fixing claw 80 has started moving.

The above-described configuration is achieved by providing a flat portion parallel to a plane Y-Z on the right side of the move and stop switching slope 75 in FIG. 1, and by causing the contact plate hooking face 94 to contact the flat portion when the releasing button 70 is near a position at which the releasing button 70 becomes the released state.

In this configuration, as the releasing button 70 starts to slide from the released state to the fixed state, the fixing claw upper end portion 83 is lowered along the releasing slope 73 and the fixing claw 80 at the releasing position starts to move toward the fixing position. By contrast, the portion to which the contact plate hooking face 94 contacts slides on the flat portion as the releasing button 70 started to slide, and therefore there is no amount of projection of the portion to which the contact plate hooking face 94 contacts in the negative X-axis direction, in other words, the portion to which the contact plate hooking face 94 contacts is not projected in the negative X-axis direction. Therefore, no operation to switch to a state in which the trailing end contact plate 90 becomes movable is started. Thereafter, the portion to which the contact plate hooking face 94 contacts corresponds to the move and stop switching slope 75. Therefore, as the contact plate hooking face 94 starts to move in the positive X-axis direction along the move and stop switching slope 75, the operation to switch to the state in which the trailing end contact plate 90 is movable by application of the biasing force is started.

Accordingly, when the fixing claw 80 moves from the releasing position to the fixing position, the operation to switch from the state in which the trailing end contact plate 90 is regulated from moving to the state in which the trailing end contact plate 90 is movable, after the fixing claw 80 is started to move.

At the initial stage when the releasing button 70 is started to slide from the fixed state to the released state, the portion to which the fixing claw upper end portion 83 contacts slides along the fixing slide plane 78 and the fixing claw 80 at the fixing position is not started to move to the releasing position. Thereafter, when the portion to which the fixing claw upper end portion 83 contacts reaches the releasing slope 73, the fixing claw upper end portion 83 is moved upwardly along the releasing slope 73, and the fixing claw 80 is started to move to the releasing position.

By contrast, as the releasing button 70 starts to slide to the released state, the portion to which the contact plate hooking face 94 contacts is started to move in the negative X-axis direction along the move and stop switching slope 75, and the operation to switch to the regulated state in which the trailing end contact plate 90 is regulated from moving by application of the biasing force is started.

Accordingly, when the fixing claw 80 moves from the fixing position to the releasing position, the operation to switch from the movable state in which the trailing end contact plate 90 is movable to the regulated state in which the trailing end contact plate 90 is regulated from moving, before the fixing claw 80 is started to move.

With the above-described configuration, the pressing force is generated when the trailing end contact plate 90 presses the trailing end of the sheet P by the biasing force of the contact plate biasing spring 91, and the end fence 60 is moved to the upstream side of the sheet conveying direction due to the reaction force against the pressing force. Accordingly, the end fence 60 is prevented from shifting to generate the positional deviation of the end fence 60 on the bottom face 301*a*.

When the releasing button 70 slides and the fixing claw 80 is moved from the releasing position to the fixing position, it is preferable that the operation to switch from the regulated state in which the trailing end contact plate 90 is regulated from moving to the movable state in which the trailing end contact plate 90 is movable is started after the fixing claw 80 is moved to the fixing position. Similarly, when the releasing button 70 slides and the fixing claw 80 is moved from the fixing position to the releasing position, it is preferable that the operation to switch from the movable state in which the trailing end contact plate 90 is movable to the regulated state in which the trailing end contact plate 90 is regulated from moving is started before the fixing claw 80 is started to move.

The above-described configuration is achieved by the following setting.

Specifically, a flat portion parallel to the plane Y-Z is provided on the right side of the move and stop switching slope 75 in FIG. 1. Then, the length of the flat portion in the Y-axis direction is set to be longer or greater than the length of the releasing slope 73 in the Y-axis direction. According to this setting, while the releasing button 70 is sliding within a range that the fixing claw upper end portion 83 contacts the releasing slope 73, the contact plate hooking face 94 remains in contact with the flat portion. Accordingly, while the fixing claw 80 is moving, the position of the contact plate hooking face 94 in the X-axis direction does not vary, and therefore the operation to switch from the regulated state in which the trailing end contact plate 90 is regulated from moving to the movable state in which the trailing end contact plate 90 is movable is not performed.

According to the above-described setting, while the releasing button 70 is sliding within a range that the fixing claw upper end portion 83 contacts the fixing slide plane 78, in other words, in the state in which the fixing claw 80 is located at the fixing position, the contact plate hooking face 94 faces the move and stop switching slope 75. Then, as a position of the move and stop switching slope 75 at which the contact plate hooking face 94 faces varies, the operation to switch from the regulated state in which the trailing end contact plate 90 is regulated from moving to the movable state in which the trailing end contact plate 90 is movable is performed.

In this configuration, it is that the fixing claw 80 is located at the fixing position when the trailing end contact plate 90 is movable by the biasing force. Specifically, as the pressing to the releasing button 70 is cancelled, the end fence 60 is fixed by the fixing claw 80, and then the trailing end contact plate 90 becomes rotatable in the direction indicated by arrow D1 in FIG. 17. According to this configuration, by the reaction force against the pressing force applied when the trailing end contact plate 90 presses the trailing end of the sheet P by the biasing force of the contact plate biasing spring 91, the end fence 60 is prevented from moving on the bottom face 301*a*.

The sheet feed tray 30 that functions as a sheet loading device according to the present embodiment includes the tray housing 301 on which the sheet P to be fed to the image forming device 400 is loaded, and the end fence 60. Since the end fence 60 includes the fixing claw 80 and the releasing button 70 and the releasing button 70 has a function as a contact body, the position of the sheet P loaded on the bottom face 301*a* of the tray housing 301 is stabilized.

Further, the sheet feeding device 300 according to the present embodiment includes the sheet feed tray 30 and the sheet feed roller 47. Since the end fence 60 provided to the sheet feed tray 30 includes the fixing claw 80 and the releasing button 70 and the releasing button 70 has a function as a contact body, the position of the sheet P on the sheet feed tray 30 is stabilized, and a stable sheet feeding is achieved.

Further, the image forming apparatus 100 according to the present embodiment includes the image forming device 400 and the sheet feeding device 300. Since the end fence 60 provided to the sheet feed tray 30 of the sheet feeding device 300 includes the fixing claw 80 and the releasing button 70 and the releasing button 70 has a function as a contact body, a stable sheet feeding is achieved, and therefore the timing to feed the sheet P to the secondary transfer nip region is stabilized. Accordingly, defect such as the positional deviation of an image is prevented, and therefore the stable image formation is achieved.

In the present embodiment, the trailing end contact plate 90 is moved to the upstream side of the sheet conveying direction against the biasing force of the fixing claw biasing spring 81 by causing the position of the move and stop switching slope 75 facing the contact plate hooking face 94 to slide. Accordingly, in this configuration, the state is switched from the movable state in which the trailing end contact plate 90 is movable to the regulated state in which the trailing end contact plate 90 is regulated from moving.

To switch the state between the movable state in which the trailing end contact plate 90 is movable due to the biasing force of the fixing claw biasing spring 81 and the regulated state in which the trailing end contact plate 90 is regulated from moving, the following configuration may also be applied to this disclosure. Specifically, in the configuration, a biased state in which the biasing force of the fixing claw biasing spring 81 is applied to the trailing end contact plate 90 and a non-biased state in which the biasing force of the fixing claw biasing spring 81 is not applied to the fixing claw biasing spring 81.

In the present embodiment, the description was given of the case in which a sheet end position regulator that includes a fixing body and a contact body corresponds to the end fence 60 that is movable in the sheet conveying direction. The sheet end position regulating device according to this disclosure is not limited to the end fence 60. For example, a side fence that is movable in a direction perpendicular to the sheet conveying direction is also applicable as the sheet end position regulating device to this disclosure.

Further, in the above-described embodiments and examples, the description was given of the case where the sheet loader to which the sheet end position regulating device is movably attached corresponds to the bottom face 301*a* of the tray housing 301 of a housing type whose side is covered with a wall or walls. However, the configuration including a sheet loader to which a sheet end position regulating device according to this disclosure is attached is not limited to the above-described housing type. For example, a configuration in which an end fence and a side fence or fences are mounted on a planar tray that forms a sheet loader may be applied.

The configurations according to the above-descried embodiments are not limited thereto. This disclosure can achieve the following aspects effectively.

Aspect 1

In Aspect 1, a sheet end position regulating device (for example, the end fence 60) includes a first contact body (for example, the trailing end contact plate 90) disposed movable on a sheet loading portion (for example, the bottom face 301*a*) on which a sheet (for example, the sheet P) is loaded and configured to contact an end portion of the sheet, a fixing body (for example, the fixing claw 80) disposed movable between a fixing position at which a position of the first contact body to the sheet loading portion is fixed and a releasing position at which the position of the first contact body is released, and a second contact body (for example, the releasing button 70) disposed movable between a contact position at which the fixing body contacts a contact target portion (for example, fixing claw upper end portion 83) to regulate movement of the fixing body form the fixing position to the releasing position and a non-contact position at which the fixing body does not contact the contact target portion.

In a case in which a large impact is applied to the sheet loader to which the sheet end position regulating device is disposed, a force to move the fixing body at the fixing position to the releasing position may be applied.

In a comparative configuration in which the biasing body restrains the movement of the fixing body from the fixing position to the releasing position, when the force applied to the fixing body to move to the releasing position is greater than the biasing force of the biasing body, the fixing body is moved to the releasing position, and therefore the position of the fixing body relative to the sheet loader varies.

In Aspect 1, the fixing body is regulated from moving to the releasing position by the causing the contact body to contact the fixing body. Therefore, even if the force is applied to the fixing body at the fixing position to move toward the releasing position, the fixing body is prevented from moving to the releasing position. Therefore, the position of the sheet end position regulating device to the sheet loader is not varied at an intentional timing, for example, even if a large impact is applied to the sheet loader.

Aspect 2

In Aspect 1, the sheet end position regulating device further includes a releasing body (for example, the releasing slope 73) configured to cause the fixing body to move from the fixing position to the releasing position. The releasing body is configured to move along with movement of the second contact body from the contact position to the non-contact position and cause the fixing body to move from the fixing position to the releasing position.

According to this configuration, as described in the above embodiment, the releasing body is operated along with the operation of the second contact body. Accordingly, the operability is enhanced.

Aspect 3

In Aspect 2, the second contact body is configured to cause the fixing body from moving to the releasing position when the fixing body is located at the fixing position. The second contact body moves to the non-contact position immediately before the releasing body causes the fixing body to move the releasing position.

According to this configuration, as described in the above embodiment, it is prevented that the fixing body moves to the releasing position at the unintentional timing immediately before the fixing body is moved to the releasing position by the releasing body.

Aspect 4

In any one of Aspects 1 through 3, the sheet end position regulating device further includes a biasing body (for example, the contact plate biasing spring 91) configured to apply a biasing force and bias the first contact body toward an end of the sheet, and a switching body (for example, the move and stop switching slope 75) configured to switch the biasing force applied by the biasing body between a force applying state in which the biasing force of the biasing body is applied to the end of the sheet via the first contact body and a force suspending state in which the biasing force of the biasing body is not applied to the end of the sheet via the first contact body. The switching body is configured to switch the force applying state and the force suspending state along with movement of the fixing body.

According to this configuration, as described in the above embodiment, the switching body switches the state to the force suspending state, so that the sheet end position regulating device is easily set to the sheet bundle of sheets P loaded on the sheet loader at an appropriate positional relation, and therefore an erroneous setting is prevented.

In addition, the switching body switches the state between the force applying state and the force suspending state by moving along with movement of the fixing body, and therefore the operability is enhanced.

Aspect 5

In Aspect 4, the switching body is in the force applying state when the fixing body is located at the fixing position and the switching body is in the force suspending state when the fixing body is located at the releasing position.

According to this configuration, as described in the above embodiment, when the fixing body is located at the releasing position and the sheet end position regulating device is movable, by changing the state to the force suspending state, the position of the sheet end position regulating device due to the biasing force of the biasing body is restrained from being shifted.

Aspect 6

In Aspect 5, when the fixing body moves from the releasing position to the fixing position, the switching body starts switching to the force applying state after the fixing body has started to move, and when the fixing body moves from the fixing position to the releasing position, the switching body starts switching to the force suspending state before the fixing body starts to move.

According to this configuration, as described in the above embodiment, when the biasing body biases the end portion of the sheet via the first contact body, the fixing body is set to the fixing position, and when the fixing body is located at the releasing position, it is prevented that the biasing force of the biasing body is applied to the end portion of the sheet. Therefore, by the reaction force when the biasing body applies the biasing force to the end portion of the sheet via the contact portion in the force applying state, the position of the sheet end position regulating device with respect to the sheet loader is restrained from being shifted.

Aspect 7

In any one of Aspects 1 through 3, the sheet end position regulating device further includes a biasing body (for example, the contact plate biasing spring 91) configured to apply a biasing force and bias the first contact body toward an end of the sheet, and a switching body (for example, the move and stop switching slope 75) configured to switch the position of the first contact body between a first state in which the biasing force of the biasing body causes the first contact body to move toward the end portion of the sheet away from a given position and a second state in which the first contact body is regulated from being moved, by the biasing force of the biasing body, toward the end portion of the sheet away from the given position, along with movement of the fixing body.

According to this configuration, as described in the above embodiment, the switching body switches the state to the second state, so that the sheet end position regulating device is easily set to the sheet bundle of sheets P loaded on the sheet loader at an appropriate positional relation, and therefore an erroneous setting is prevented.

In addition, the switching body switches the state between the force applying state and the force suspending state by moving along with movement of the fixing body, and therefore the operability is enhanced.

Aspect 8

In Aspect 7, the switching body is in the first state when the fixing body is located at the fixing position, and the switching body is in the second state when the fixing body is located at the releasing position.

According to this configuration, as described in the above embodiment, when the fixing body is located at the releasing position and the sheet end position regulating device is movable, the state is in the second state in which the first contact body is prevented from moving due to the biasing force of the biasing body.

Accordingly, the shift of the position of the sheet end position regulating device due to the biasing force of the biasing body is restrained.

Aspect 9

In Aspect 8, when the fixing body moves from the releasing position to the fixing position, the switching body starts switching to the first state after the fixing body has started to move, and when the fixing body moves from the fixing position to the releasing position, the switching body starts switching to the second state before the fixing body starts to move.

According to this configuration, as described in the above embodiment, when the state is changed to the first state in which the first contact body is movable due to the biasing force of the biasing body, the fixing body is set to be located at the fixing position. Therefore, when the fixing body is located at the releasing position, the first contact body is moved by the biasing force of the biasing body, so that it is prevented that the first contact body presses the end of the sheet. Therefore, by the reaction force against the force by which the first contact body that is movable in the first state presses the end portion of the sheet, the position of the sheet end position regulating device with respect to the sheet loader is restrained from being shifted.

Aspect 10

In Aspect 10, a sheet end position regulating device (for example, the end fence 60) includes a first contact body (for example, the trailing end contact plate 90) disposed movable on a sheet loading portion (for example, the bottom face 301*a*) on which a sheet (for example, the sheet P) is loaded and configured to contact an end portion of the sheet, a fixing body (for example, the fixing claw 80) disposed movable between a fixing position at which a position of the first contact body to the sheet loading portion is fixed and a releasing position at which the position of the first contact body is released, a biasing body (for example, the contact plate biasing spring 91) configured to apply a biasing force and bias the first contact body toward an end of the sheet, and a switching body (for example, the move and stop switching slope 75) configured to switch the biasing force applied by the biasing body between a force applying state in which the biasing force of the biasing body is applied to the end of the sheet via the first contact body and a force suspending state in which the biasing force of the biasing body is not applied to the end of the sheet via the first contact body. The switching body starts to switch to the force applying state after the fixing body has started to move when the fixing body moves from the releasing position to the fixing position. The switching body starts to switch to the force suspending state before the fixing body starts to move when the fixing body moves from the fixing position to the releasing position.

According to this configuration, as described in the above embodiment, when the biasing body biases the end portion of the sheet via the first contact body, the fixing body is set to the fixing position, and when the fixing body is located at the releasing position, it is prevented that the biasing force of the biasing body is applied to the end portion of the sheet. Therefore, by the reaction force when the biasing body applies the biasing force to the end portion of the sheet via the contact portion in the force applying state, the position of the sheet end position regulating device with respect to the sheet loader is restrained from being shifted.

Aspect 11

In Aspect 6 or Aspect 10, the switching body starts to switch to the force applying state after the fixing body has moved to the fixing position when the fixing body moves from the releasing position to the fixing position, and the switching body ends switching to the force suspending state before the fixing body starts to move when the fixing body moves from the fixing position to the releasing position.

According to this configuration, as described in the above embodiment, by the reaction force against the force by which the first contact body presses the end portion of the sheet in the force applying state, the position of the sheet end position regulating device with respect to the sheet loader is prevented from being shifted.

Aspect 12

In Aspect 9, when the fixing body moves from the releasing position to the fixing position, the switching body starts switching to the first state after the fixing body has moved to the fixing position, and when the fixing body moves from the fixing position to the releasing position, the switching body ends switching to the second state before the fixing body starts to move.

According to this configuration, as described in the above-described embodiment, by the reaction force against the force by which the first contact body that is movable presses the end portion of the sheet in the first state, the position of the sheet end position regulating device with respect to the sheet loader is prevented from being shifted.

Aspect 13

A sheet loader (for example, the sheet feed tray 30) includes a sheet loading portion (for example, the bottom face 301*a*) on which a sheet (for example, the sheet P) is loaded, and the sheet end position regulating device (for example, the end fence 60) of Aspect 1, disposed movable to the sheet loading portion and configured to regulate an end portion of the sheet loaded on the sheet loading portion.

According to this configuration, as described in the above embodiment, the position of the sheet on the sheet loader is stabilized.

Aspect 14

A sheet feeder (for example, the sheet feeding device 300) includes the sheet loader (for example, the sheet feed tray 30) of Aspect 13, on which a sheet (for example, the sheet P) is loaded, and a sheet feeding body (for example, the sheet feed roller 47) configured to feed the sheet loaded on the sheet loader.

According to this configuration, as described in the above embodiment, the position of the sheet on the sheet loading portion of the sheet loader is stabilized, and therefore a stable sheet feeding operation is achieved.

Aspect 15

In Aspect 15, an image forming device (for example, the image forming device 400) configured to form an image on a sheet (for example, the sheet P), and the sheet feeder (for example, the sheet feeding device 300) of Aspect 14, configured to feed the sheet toward the image forming device.

According to this configuration, as described in the above embodiment, a stable sheet feeding operation is performed, and therefore a defect such as a positional deviation of an image is prevented, so that a stable image forming operation is performed.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet end position regulating device comprising:

a first contact body on an end face of the sheet end position regulating device and disposed movable toward a sheet loading portion on which a sheet is loaded and configured to contact an end portion of the sheet;

a fixing body movable in to and out of the sheet end position regulating device between a fixing position at which a position of the first contact body to the sheet loading portion is fixed and a releasing position at which the position of the first contact body is released; and a second contact body movable in to and out of the sheet end position regulating device between a contact position at which the fixing body contacts a portion of the second contact body to regulate movement of the fixing body from the fixing position to the releasing position and a non-contact position at which the fixing body does not contact the portion of the second contact body, the second contact body having a first wedge shaped portion slidably engageable with the fixing body and a second wedge shaped portion slidably engageable with the first contact body, wherein the second contact body is movable in a direction perpendicular to a moving direction of the sheet end position regulating device and the fixing body is movable perpendicular to the moving direction of the second contact body.

2. The sheet end position regulating device according to claim 1, wherein the first wedge shaped portion is a releasing body configured to cause the fixing body to move from the fixing position to the releasing position, wherein the second contact body includes the releasing body configured to move along with movement of the second contact body from the contact position to the non-contact position and engage with the fixing body and cause the fixing body to move from the fixing position to the releasing position.

3. The sheet end position regulating device according to claim 2, wherein the second contact body is configured to regulate the fixing body from moving to the releasing position when the fixing body is located at the fixing position, and wherein the second contact body moves to the non-contact position immediately before the releasing body causes the fixing body to move to the releasing position.

4. The sheet end position regulating device according to claim 1, further comprising;

a biasing body in contact with the first contact body and configured to apply a biasing force and bias the first contact body toward the end portion of the sheet, wherein the second contact body includes a switching body configured to switch the biasing force applied by the biasing body between a force applying state in which the biasing force of the biasing body is applied to the end portion of the sheet via the first contact body and a force suspending state in which the biasing force of the biasing body is not applied to the end portion of the sheet via the first contact body, wherein the switching body is configured to switch the force applying state and the force suspending state along with movement of the fixing body.

5. The sheet end position regulating device according to claim 4, wherein the switching body is in the force applying state when the fixing body is located at the fixing position, and wherein the switching body is in the force suspending state when the fixing body is located at the releasing position.

6. The sheet end position regulating device according to claim 5, wherein, when the fixing body moves from the releasing position to the fixing position, the switching body starts switching to the force applying state after the fixing body has started to move, and wherein, when the fixing body moves from the fixing position to the releasing position, the switching body starts switching to the force suspending state before the fixing body starts to move.

7. The sheet end position regulating device according to claim 6, wherein the switching body starts to switch to the force applying state after the fixing body has moved to the fixing position when the fixing body moves from the releasing position to the fixing position, and wherein the switching body ends switching to the force suspending state before the fixing body starts to move when the fixing body moves from the fixing position to the releasing position.

8. The sheet end position regulating device according to claim 1, further comprising:

a biasing body in contact with the first contact body and configured to apply a biasing force and bias the first contact body toward the end portion of the sheet, wherein a switching body is configured to switch the position of the first contact body between a first state in which the biasing force of the biasing body causes the first contact body to move toward the end portion of the sheet away from a given position and a second state in which the first contact body is regulated from being moved, by the biasing force of the biasing body, toward the end portion of the sheet away from the given position, along with movement of the fixing body.

9. The sheet end position regulating device according to claim 8, wherein the switching body is in the first state when the fixing body is located at the fixing position, and wherein the switching body is in the second state when the fixing body is located at the releasing position.

10. The sheet end position regulating device according to claim 9, wherein, when the fixing body moves from the releasing position to the fixing position, the switching body starts switching to the first state after the fixing body has started to move, and wherein, when the fixing body moves from the fixing position to the releasing position, the switching body starts switching to the second state before the fixing body starts to move.

11. The sheet end position regulating device according to claim 10, wherein, when the fixing body moves from the releasing position to the fixing position, the switching body starts switching to the first state after the fixing body has moved to the fixing position, and wherein, when the fixing body moves from the fixing position to the releasing position, the switching body ends switching to the second state before the fixing body starts to move.

12. A sheet loader comprising:

the sheet loading portion on which the sheet is loaded; and the sheet end position regulating device according to claim 1, disposed movable to the sheet loading portion and configured to regulate the end portion of the sheet loaded on the sheet loading portion.

13. A sheet feeder comprising:

the sheet loader according to claim 12, on which the sheet is loaded; and a sheet feeding body configured to feed the sheet loaded on the sheet loader.

14. An image forming apparatus comprising:

an image forming device configured to form an image on a sheet; and the sheet feeder according to claim 13, configured to feed the sheet toward the image forming device.

15. The sheet end position regulating device according to claim 1, wherein the second contact body is movable into and out of the sheet end position regulating device in a direction orthogonal to a sheet conveying direction and parallel to the sheet loading portion, and the portion of the second contact body varies in thickness.

16. A sheet end position regulating device comprising:

a first contact body disposed movable toward a sheet loading portion on which a sheet is loaded and configured to contact an end portion of the sheet;

a fixing body disposed movable between a fixing position at which a position of the first contact body to the sheet loading portion is fixed and a releasing position at which the position of the first contact body is released;

a biasing body configured to apply a biasing force and bias the first contact body toward the end portion of the sheet; and a switching body movable in to and out of the sheet end position regulating device in a direction orthogonal to a sheet conveying direction and parallel to the sheet loading portion, and configured to switch the biasing force applied by the biasing body between a force applying state in which the biasing force of the biasing body is applied to the end portion of the sheet via the first contact body and a force suspending state in which the biasing force of the biasing body is not applied to the end portion of the sheet via the first contact body, the switching body configured to start to switch to the force applying state after the fixing body has started to move when the fixing body moves from the releasing position to the fixing position, the switching body having a first wedge shaped portion slidably engageable with the fixing body and a second wedge shaped portion slidably engageable with the first contact body and configured to start to switch to the force suspending state before the fixing body starts to move when the fixing body moves from the fixing position to the releasing position.

17. The sheet end position regulating device according to claim 16, wherein the switching body starts to switch to the force applying state after the fixing body has moved to the fixing position when the fixing body moves from the releasing position to the fixing position, and wherein the switching body ends switching to the force suspending state before the fixing body starts to move when the fixing body moves from the fixing position to the releasing position.

18. A sheet loader comprising:

the sheet loading portion on which the sheet is loaded; and the sheet end position regulating device according to claim 16, disposed movable to the sheet loading portion and configured to regulate an end portion of the sheet loaded on the sheet loading portion.

19. A sheet feeder comprising:

the sheet loader according to claim 18, on which the sheet is loaded; and a sheet feeding body configured to feed the sheet loaded on the sheet loader.

20. An image forming apparatus comprising:

an image forming device configured to form an image on a sheet; and the sheet feeder according to claim 19, configured to feed the sheet toward the image forming device.

* * * * *